US006292638B1

(12) United States Patent
Nagamine et al.

(10) Patent No.: US 6,292,638 B1
(45) Date of Patent: Sep. 18, 2001

(54) IMAGE FORMING APPARATUS HAVING FIXING UNIT FOR MOUNTING/ DEMOUNTING

(75) Inventors: Tomoyuki Nagamine; Katsumi Takada; Susumu Imado, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/704,789

(22) Filed: Nov. 3, 2000

Related U.S. Application Data

(63) Continuation of application No. PCT/JP99/00555, filed on Feb. 9, 1999.

(30) Foreign Application Priority Data

Jun. 26, 1998 (JP) ..... 10-180566

(51) Int. Cl.[7] ..... G03G 15/16
(52) U.S. Cl. ..... 399/122
(58) Field of Search ..... 399/122, 320, 399/328, 329, 330, 331; 219/216

(56) References Cited

U.S. PATENT DOCUMENTS 4,384,781 * 5/1983 Takada .
4,682,878 * 7/1987 Takizawa et al. .
4,782,359 * 11/1988 Tomoe .
4,965,640 * 10/1990 Watarai et al. .
5,105,228 * 4/1992 Kato .
5,826,141 * 10/1998 Mitsuya .
5,956,547 * 9/1999 Kamei et al. .

FOREIGN PATENT DOCUMENTS 55-143575 11/1980 (JP) .
57-142670 9/1982 (JP) .
60-104959 6/1985 (JP) .
63-86656 6/1988 (JP) .
1-233471 9/1989 (JP) .
2-76755 6/1990 (JP) .
3-42174 4/1991 (JP) .
4-138485 5/1992 (JP) .
4-323683 11/1992 (JP) .
6-106814 4/1994 (JP) .

* cited by examiner

*Primary Examiner*—Robert Beatty
(74) *Attorney, Agent, or Firm*—Armstrong, Westerman, Hattori, McLeland & Naughton, LLP

(57) ABSTRACT

An image forming apparatus has a plurality of print assemblies for forming a color image, a fixing unit, and a paper conveyor belt for conveying a paper sheet through the print assemblies and the fixing unit. The fixing unit includes a pair of fixing rollers, a nip control mechanism for moving the pair of the fixing rollers between a nip position and a non-nip position, and a fixing unit securing member movable with the nip control mechanism. Thus, the fixing unit can be easily mounted and demounted.

5 Claims, 18 Drawing Sheets

| SELECTION | CHANGE (%) |
|---|---|
| 1 | −1.00 |
| 2 | -0.75 |
| 3 | -0.50 |
| 4 | -0.25 |
| 5 | 0 |
| 6 | 0.25 |
| 7 | 0.50 |
| 8 | 0.75 |
| 9 | 1.00 |

IMAGE FORMING APPARATUS HAVING FIXING UNIT FOR MOUNTING/DEMOUNTING

CROSS-REFERENCE TO THE RELATED APPLICATION

"This is a continuation of PCT Application No. PCT/JP99/00555, filed Feb. 9, 1999."

TECHNICAL FIELD

The present invention relates to an image forming apparatus having a fixing unit in which an image formed by at least one print assembly is transferred and fixed to a paper sheet.

BACKGROUND ART

An image forming apparatus of an electrostatic recording type comprises a print assembly including a photosensitive member (photosensitive drum), a charger, an optical head for forming an electrostatic latent image on the photosensitive member, a developing unit for converting the electrostatic latent image into a toner image and a transfer element (transfer roller) for transferring the toner image to the paper. The charger, the optical head, the developing unit and the transfer element are arranged around the photosensitive member to form a charged toner image while the photosensitive member makes one rotation. The charged toner image is transferred from the photosensitive member to the paper by the transfer element, and the paper, after the image is fixed in the fixing unit arranged behind the print assembly, is delivered.

An image forming apparatus is available which is capable of multicolor recording and comprises a plurality of print assemblies arranged in series and one fixing unit. In the case where developers of four colors including yellow, magenta, cyan and black are used, for example, the image forming apparatus comprises four print assemblies each containing one developer. The toner image formed by the print assembly of each color is superposed on the paper conveyed on a paper conveyor belt and converted into a color image.

The image forming apparatus further comprises a top cover and an end cover movably mounted on a frame. The top cover is arranged to cover a plurality of print assemblies. By opening the top cover, the component members of the print assemblies arranged in the frame can be repaired or replaced. The end cover, on the other hand, is arranged to cover the fixing unit. By opening the end cover, the fixing unit can be exposed.

Especially in a color image forming apparatus, the fixing unit is required to fix the developers of four colors, and therefore as compared with a monochromatic image forming apparatus, requires strict heating and pressing conditions. Even when the jamming of paper occurs in the fixing unit, the paper jammed in the fixing unit can be removed by opening the end cover. Once the paper has been wound around the fixing rollers, however, it is necessary to remove the fixing unit from the frame of the image forming apparatus and remove the paper from the fixing roller pair by opening the nip of the fixing rollers.

The fixing unit is secured to the frame by screws, and for the fixing unit to be removed from the frame, the screws must be removed. The removing of the screws requires a tool such as a screw driver. It is troublesome for the operator of the image forming apparatus to use a tool. Further, after removing the paper, it is necessary to mount the fixing unit on the frame and secure it on the frame by fastening the screws. In such a case, it is sometimes forgotten to tighten the screws. The job of removing the fixing unit from the frame for removing the paper wound around the fixing roller and subsequently remounting it on the frame can be comparatively troublesome.

On the other hand, the paper is conveyed to the fixing unit by a paper conveyor belt, and a paper guide the latent electrostatic image, and a transfer element for transferring the developed toner image to the paper sheet, wherein the latent image forming means is mounted on a top cover which is movably mounted on the frame to cover the print assembly.

Preferably, the nip control mechanism moves with the end cover when the end cover moves from the open position to the close position.

Preferably, the frame has a positioning pin inserted into a hole of the fixing unit for positioning the fixing unit, and the fixing unit securing means includes a lock member adapted to engage the positioning pin in cooperation with the nip control mechanism.

Preferably, the nip control mechanism includes a manually operable level, the lock member has a cam plate movable with a lever, and the positioning pin has a small-diameter portion adapted to engage the cam plate.

According to another feature of the invention, an image forming apparatus comprises a frame, at least one print assembly capable of forming an image, a pair of fixing rollers for holding and conveying a paper sheet, an inlet-side paper guide arranged to be movable vertically with respect to a paper passage in accordance with a thickness of the paper sheet for guiding the paper sheet between the fixing rollers, and a paper sheet conveyor belt for conveying the paper sheet to the fixing unit through the print assembly and the inlet-side guide.

In this configuration, the inlet-side paper guide is vertically movable, and therefore the paper is prevented from jumping up when the rear end thereof leaves the paper sheet conveyor means.

Preferably, the inlet-side paper guide is composed of an elastic member which is flexible in accordance with a thickness of the paper sheet.

Preferably, the image forming apparatus comprises means for moving the inlet-side paper guide in accordance with the kind of the paper. Most of the toner is attached and scraped off at the forward end of the cleaning felt, after which the cleaning efficiency and the service life of the cleaning felt are reduced.

SUMMARY OF THE INVENTION

An object of the present invention is to provide an image forming apparatus in which the fixing unit can be easily mounted and demounted.

Another object of the invention is to provide an image forming apparatus in which the paper is not fouled.

Still another object of the invention is to provide an image forming apparatus in which the cleaning unit can scrape off the toner from the fixing unit efficiently over a long time.

An image forming apparatus according to the invention comprises a frame, at least one print assembly capable of forming an image, a fixing unit including a pair of fixing rollers for holding and conveying a paper sheet, a nip control mechanism for moving the pair of the fixing rollers between a nip position and a non-nip position, and fixing unit securing means movable with the nip control mechanism for securing and releasing the fixing unit to and from the frame, and paper sheet conveyor means for conveying the paper sheet to the fixing unit through the print assembly.

In this configuration, the fixing unit is fixed to the frame by the fixing unit securing means which is movable with the nip control mechanism. The fixing unit, when demounted from the frame or mounted on the frame, therefore, is automatically secured (locked) or released (unlocked) by the operation of the nip control mechanism.

Preferably, at least one print assembly includes a plurality of print assemblies each including a photosensitive member, a charger for charging the photosensitive member, latent image forming means for forming an electrostatic latent image on the photosensitive member, a developing unit for developing is arranged at the inlet of the fixing unit. The fixing rollers of the fixing unit are driven by a motor other than the drive motor for the paper conveyor belt, and the paper is conveyed by the fixing rollers of the fixing unit at a rate lower than that of the paper conveyor belt. Thus, the paper is caused to curve upward with respect to a straight line connecting the outlet end of the paper conveyor belt and the nip of the fixing rollers. The input paper guide is protruded upward slightly from the straight line connecting the outlet end of the paper conveyor belt and the nip of the fixing rollers to cause the paper to curve upward. By causing the paper to curve upward, the paper is curved in a cylindrical form so that rigidity is given to the paper and the paper is prevented from wrinkling.

In the case where the paper is curved between the outlet end of the paper conveyor belt and the nip of the fixing rollers, however, the rear end of the paper is released into a free state suddenly after leaving the outlet end of the paper conveyor belt, often with the result that the rear end of the paper jumps up. The rear end of the paper, once it has jumped up, may be fouled by rubbing against the upper paper suction guide and the print assembly. The amount of jumping up of the rear end of the paper increases with the paper thickness. Especially, the rear end of a thick paper sheet jumps up to a large extent.

Further, an oil supply felt is arranged upstream of the nip of the upper one of the fixing rollers, while a cleaning felt is arranged downstream of the nip. The oil supply felt is for coating oil on the fixing roller to prevent the paper from sticking to the fixing roller, while the cleaning felt is for scraping off the toner attached to the fixing rollers. The oil must be supplied uniformly over the width of the fixing rollers by the oil supply felt so that the toner can be scraped off efficiently, by the cleaning felt, over a long time.

According to still another feature of the invention, an image forming apparatus is characterized by comprising a frame, at least one print assembly capable of forming an image, a fixing unit including a pair of fixing rollers for holding and conveying a paper sheet, a paper sheet conveyor belt for conveying the paper through the print assembly and the fixing unit, and means capable of changing a speed of the fixing rollers relative to the speed of the paper conveyor belt in accordance with the type of the paper.

In this configuration, the paper is prevented from curling up when the rear end of the paper leaves the paper conveyor belt by changing the speed of the fixing rollers.

According to a further feature of the invention, an image forming apparatus is characterized by comprising a frame, at least one print assembly capable of forming an image, a fixing unit including a pair of fixing rollers for holding and conveying a paper sheet, and a cleaning member having at least two stripes of cleaning felt arranged so that contact pressures of the two strips of cleaning felt against the fixing roller are changed in the rotational direction of the fixing roller to clean the surface of the fixing roller, and paper conveyor means for conveying the paper sheet through the print assembly and the fixing unit.

In this configuration, the contact pressure of at least two stripes of felt can be changed, and therefore the fouling is not concentrated on one of the cleaning felts, thereby making it possible to scrape off the toner efficiently over a long life.

BRIEF DESCRIPTION OF THE DRAWINGS

The present invention will be described in detail with reference to the embodiments shown in the accompanying drawings, in which.

BEST MODE FOR CARRYING OUT THE INVENTION

Figure 1:
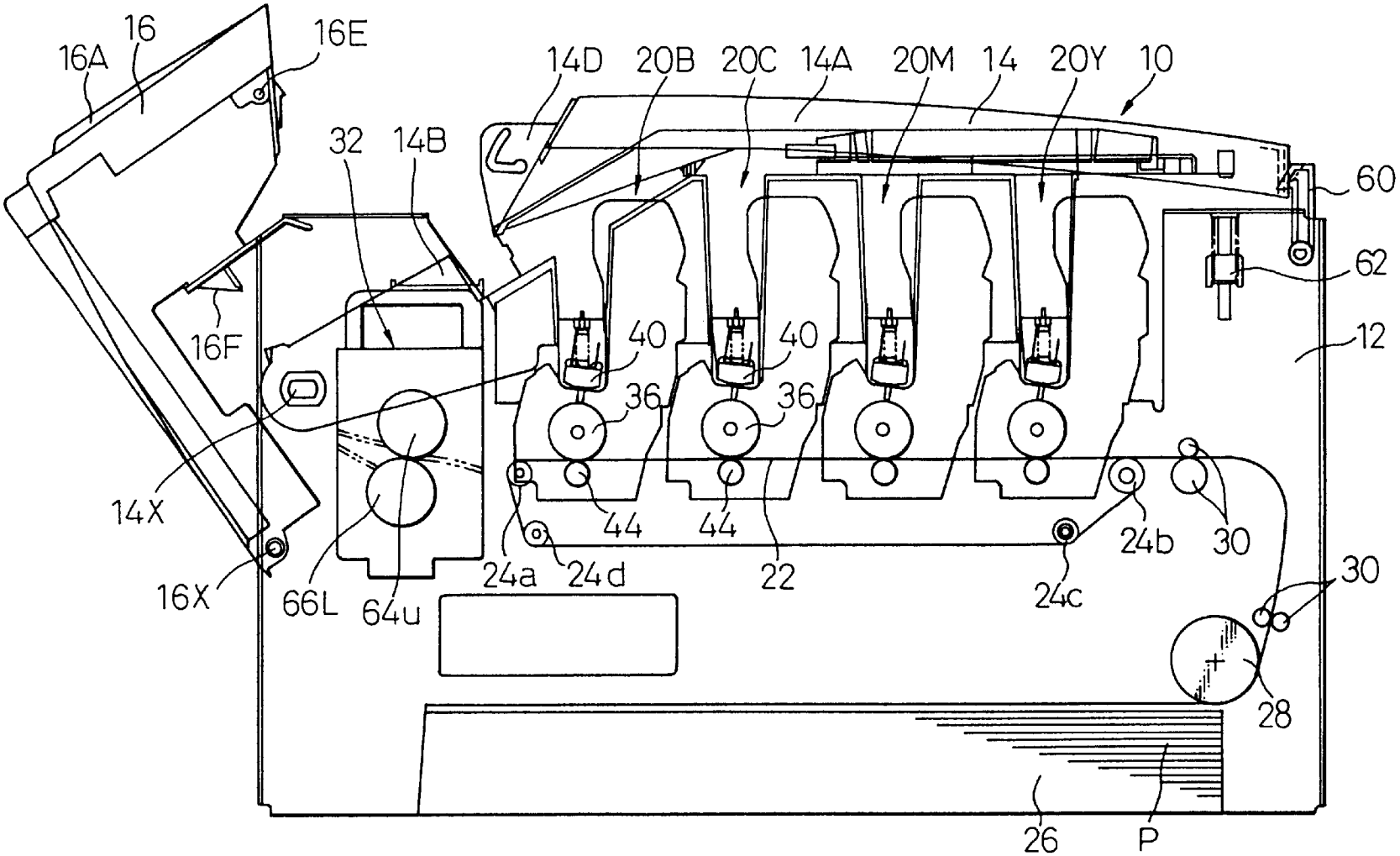
FIG. 1 is a schematic side view showing an image forming apparatus according to an embodiment of the invention.
Figure 2:
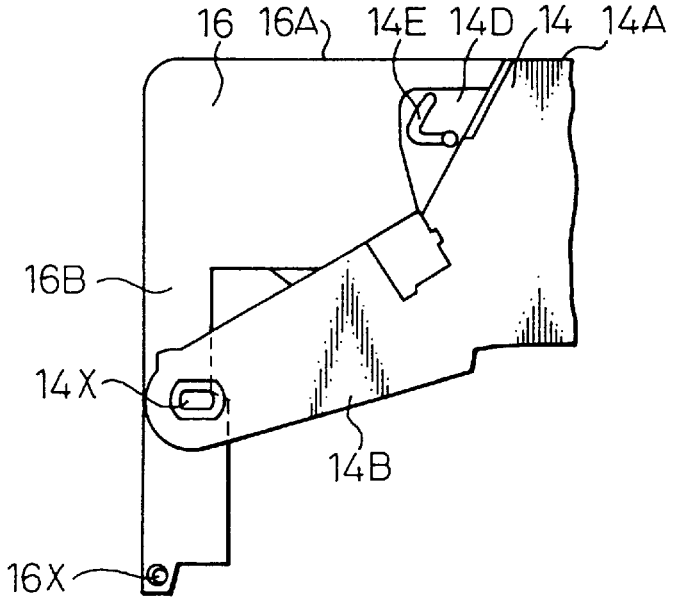
FIG. 2 is a schematic side view showing a part of the image forming apparatus of FIG. 1, with the end cover thereof in an open position.
Figure 3:
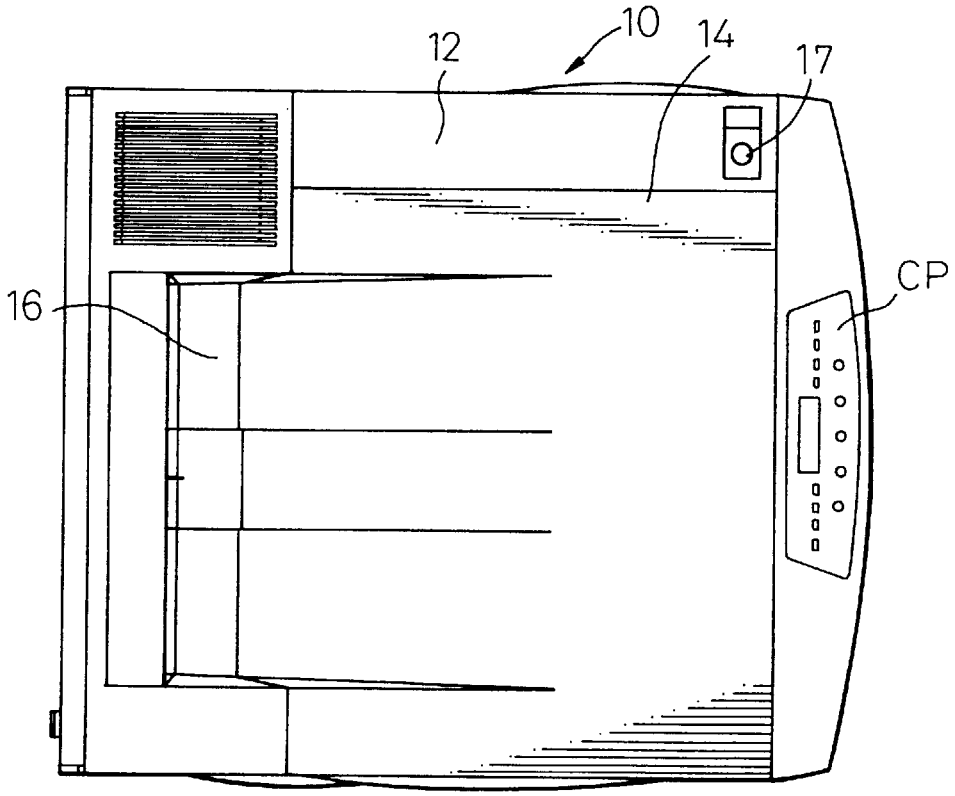
FIG. 3 is a plan view of the image forming apparatus of FIG. 1.

FIGS. 1 to 3 show an image forming apparatus 10 according to an embodiment of the invention. This image forming apparatus 10 is configured as a full-color printer. The image forming apparatus 10 has a frame 12 on which a top cover 14 and an end cover 16 are movably mounted. FIG. 1 shows the top cover 14 in the closed position and the end cover 14 in the open position. FIG. 2 shows the top cover 14 is in the closed position and the end cover 16 in the closed position. By opening the top cover 14 and the end cover 16, it is possible to obtain access to the members in the image forming apparatus 10. When the top cover 14 is opened, therefore, component elements 20 of a print assembly can be repaired or replaced, while by opening the end cover 16, a fixing unit 32 can be repaired and the paper jam can be removed.

FIG. 3 is a plan view of the image forming apparatus 10 having the top cover 14 and the end cover 16. The image forming apparatus 10 includes a control panel CP at the right end of FIG. 3. In the drawing, the right end where the control panel CP is located is the front side of the apparatus and the left end is the rear side of the apparatus. The end cover 16 is located at the end remote from the control panel CP. An unlock button 17 for the top cover 14 is located on the front side of the apparatus. The unlock button 17 is operatively coupled to a lock member 60 of FIG. 1, and the lock is released by depressing the unlock button 17 so that the top cover 14 can be opened. FIG. 1 includes a cover lift mechanism 62 urged by a spring, such that when the lock is released, the cover lift mechanism 62 pushes up the top cover 14 by a predetermined amount and thus the top cover 14 can be manually opened.

In FIGS. 1 and 2, the top cover 14 includes a cover portion 14A and side plate portions 14B. The portion of the top cover 14 visible in FIG. 3 is the cover portion 14A, and the side plate portions 14B extend rearward and downward from the sides of the cover portion 14A. The side plate portions 14B of the top cover 14 are pivotally coupled to pivotal support members 14X located at the rear portion of the frame 12. The end cover 16 also has a cover portion 16A and side plate portions 16B which are pivotally coupled to the pivotal support members 16X located under the pivotal support members 14X of the top cover 14.

Figure 4:
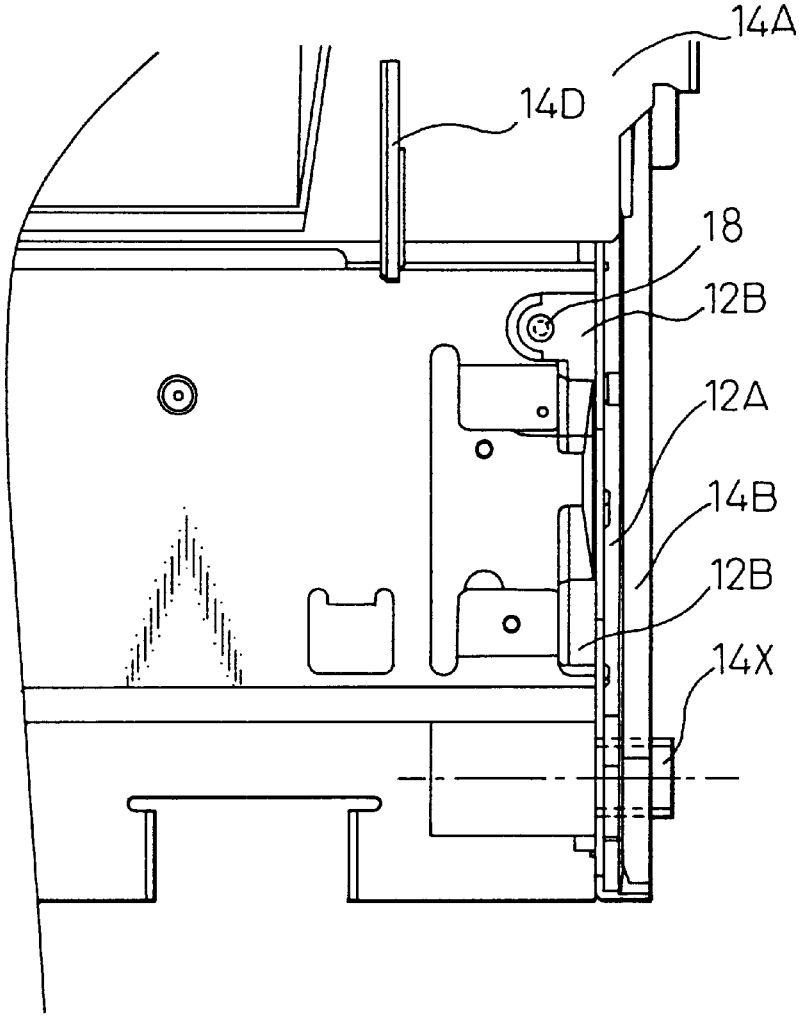
FIG. 4 is a plan view showing a part of the image forming apparatus of FIG. 1, with the end cover omitted.

FIG. 4 is a plan view showing a part of the frame 12 and the top cover 14 with the end cover 16 omitted. The frame 12 has vertically extending side plate members 12A. The side plate portion 14B of the top cover 14 is pivotally coupled to the pivotal support member 14X arranged on the side plate member 12A of the frame 12. Further, the top cover 12 has a connecting portion 14D arranged vertically at the rear end portion of the cover portion 14A and coupling the top cover 12 and the end cover 16 to each other. In FIGS. 1 and 2, the connecting portion 14D includes an L-shaped coupling slit 14E, and a pin 16E extending from the side plate portion 16B of the end cover 16 is inserted in the coupling slit 14E. Thus, the end cover 16 is opened and closed with the top cover 12. Specifically, while the top cover 14 moves to a slightly opened position from the closed position, the end cover 16 remains stationary, and as the top cover 14 opens further, the end cover 16 opens with the top cover 14. In addition, as shown in FIG. 1, the end cover 16 only can be opened independently of the top cover 14. This is because the pin 16E of the side plate portion 16B of the end cover 16 is urged by a spring (not shown) arranged in the side plate portion 16B to be protruded or retreated from the surface of the side plate portion 16B. The pin 16E, when protruded from the surface of the side plate portion 16B, engages the coupling slit 14E. When retreated toward the surface of the side plate portion 16B against the spring force, on the other hand, the pin 16E comes off from the coupling slit 14E, so that the end cover 16 and the top cover 14 are decoupled and the end cover 14 can be moved separately.

Figure 5:
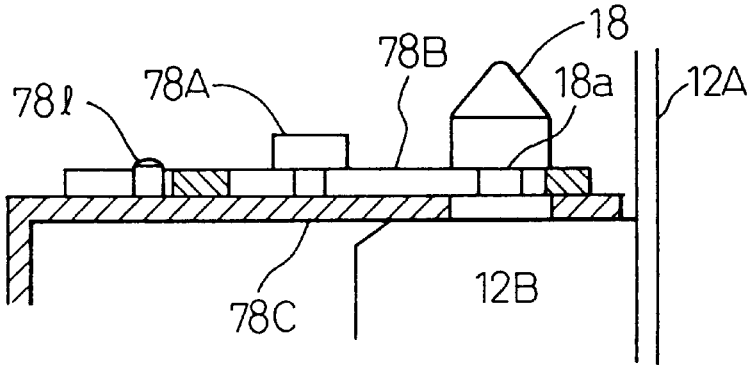
FIG. 5 is a partial sectional view of the apparatus, showing the positioning pin provided on the support member of the frame and the fixing unit mounting member.

In FIGS. 4 and 5, the frame 12 further includes support members 12B inside the side plate member 12A, the support member 12B having a vertically extending pin 18. The support member 12B is a portion of the frame 12 that supports the fixing unit 32. The positioning pin 18 and the support member 12B will be described in detail later.

In FIG. 1, the image forming apparatus 10 comprises four print assemblies 20B, 20C, 20M and 20Y. An endless paper sheet conveyor belt 22 is arranged for the four print assemblies 20B, 20C, 20M and 20Y. The paper sheet conveyor belt 22 is formed of an appropriate transparent synthetic resin material and arranged around four rollers 24*a*, 24*b*, 24*c* and 24*d*. The roller 24*a* is a drive roller and also functions as an AC neutralizing roller for removing the charge from the paper sheet conveyor belt 22. The roller 24*b* is a driven roller and also functions as a charging roller for attaching charge to the paper sheet conveyor belt 22. The rollers 24*c* and 24*d* are both guide rollers. The roller 24*d* is a tension roller for giving an appropriate tension to the paper sheet conveyor belt 22.

A hopper 26 is arranged under the paper sheet conveyor belt 22. A bundle of paper sheets is stacked in the hopper 26. The paper sheets P are supplied, one by one, by a pick roller 28 from the hopper 26, and transported to the paper sheet conveyor belt 22 by paper feed rollers 30. A paper sheet P is delivered to the print assemblies 20B, 20C, 20M and 20Y by the paper sheet conveyor belt 22 and printed or recorded. The paper sheet P thus recorded is conveyed to the fixing unit 32 and discharged into the stacker formed on the upper surface of the top cover 14 through an appropriate guide roller (not shown) arranged on the end cover 16.

The paper sheet conveyor belt 22 is charged by the driven roller 24*b* and, therefore, the paper sheet P is electrostatically attracted and held by the paper sheet conveyor belt 22 when introduced to the paper sheet conveyor belt 22 from the driven roller 24*b*. Thus, the paper sheet P is held in a fixed relative position with respect to the paper sheet conveyor belt 22. On the other hand, the drive roller 24*a* functions as a neutralizing roller, so the charge is removed and the paper sheet P can be easily released from the paper sheet conveyor belt 22 when passing the drive roller 24*a*. The paper sheet P released from the paper sheet conveyor belt 22 proceeds to the fixing unit 32.

The four print assemblies 20Y, 20M, 20C and 20B have identical structures. The print assembly 20Y includes a developer having a yellow toner component, and the print assembly 20M includes a developer having a magenta toner component. The print assembly 20C includes a developer having a cyan toner component, and the print assembly 20B includes a developer having a black toner component. Thus, these print assemblies 20Y, 20M, 20C and 20B form a full-color toner image by printing a yellow toner image, a magenta toner image, a cyan toner image and a black toner image, respectively, on the paper P held and moved by the paper sheet conveyor belt 22.

Figure 6:
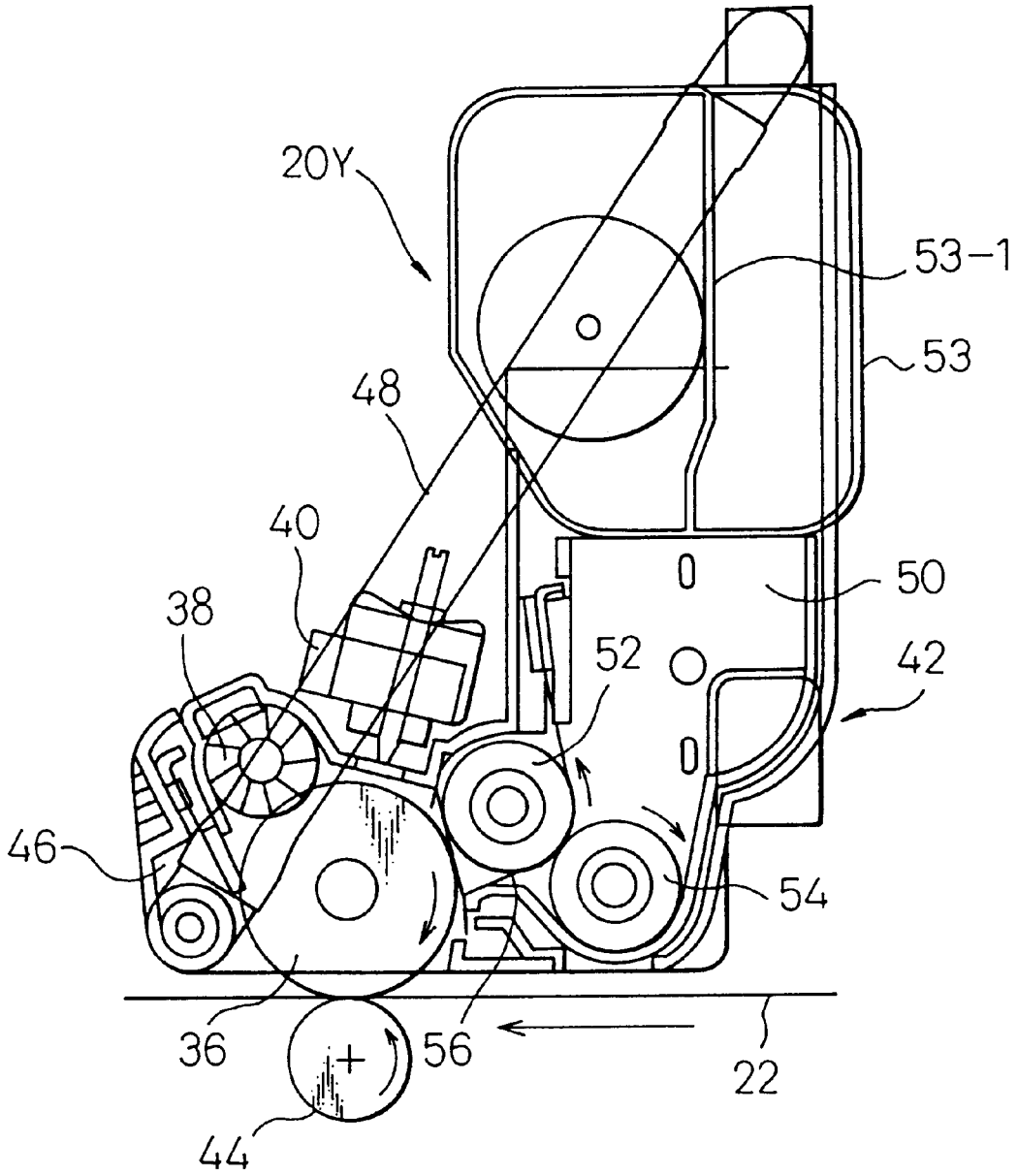
FIG. 6 is a side view showing the print assembly of FIG. 1.

FIG. 6 shows a print assembly 20Y. The other print assemblies 20M, 20C and 20B also have a similar structure, and therefore only the print assembly 20Y will be explained in detail. The print assembly 20Y includes a photosensitive member (photosensitive drum) 36, which is rotationally driven in the direction of the arrow in FIG. 6. A precharger 38, an optical head (LED beam scanner) 40, a developing unit 42, a transfer element (transfer roller) 44 and a toner cleaner 46 are arranged, in that order, around the photosensitive member 36.

The precharger 38 arranged above the photosensitive member 36 is configured as a corona charger or a scorotoron charger, for example. The surface of the photosensitive member 36 is sequentially and uniformly charged by the precharger 38. The optical head 40 is arranged behind the precharger 38 to write an electrostatic latent image to the charge area of the photosensitive member 36 with a LED beam. Specifically, the LED beam is switched on and off based on the binary image obtained from the computer or the word processor thereby to write the electrostatic latent image as a dot image.

The electrostatic latent image written to the photosensitive member 36 is electrostatically developed as a charged toner image by a toner of a predetermined color of the developing unit 42. Then, the charged toner image is electrostatically transferred to the paper sheet P by the transfer element 44 located under the photosensitive member 36. The transfer element 44 is formed as a conductive transfer roller of a porous material (sponge). The transfer element 44 is pressed against the photosensitive member 36 through the paper sheet conveyor belt 22, and the charge of the polarity opposite to the charged toner image is applied to the paper sheet P conveyed by the paper sheet conveyor belt 22, so that the charged toner image on the photosensitive member 36 is electrostatically transferred to the paper sheet P from the photosensitive member 36.

The paper sheet P to which the charged toner image has been transferred is released by the paper sheet conveyor belt 22 and proceeds to the fixing unit 32. The toner that is not transferred to the paper sheet P is attached to the surface of the photosensitive member 36 when the transfer to the paper P is finished. The residual toner is removed by the toner cleaner 46, returned to the developing unit 42 by a toner recirculator, including a screw conveyor 48 or the like, and reused as a developing toner.

The developing unit 42 includes a developer container 50 for holding a one-component developer composed of a toner (pulverized particles of colored resin). A magnet roller, i.e. a developing roller 52 is arranged in the opening of the developer container 50 with a part of the surface thereof exposed. The developing roller 52 includes a shaft core portion fixedly supported by the two side wall portions of the developer container 50 and a sleeve of a nonmagnetic material such as aluminum arranged rotatably around the core portion. When the developing unit 42 is in operation, the sleeve of the developing roller 52 is rotated in the direction indicated by arrow in the drawing.

A detachable toner hopper 53 of the developer container 50 is arranged above the developer container 50. The toner hopper 53 contains the toner, and whenever the toner in the developer container 50 is reduced in amount, the toner in the toner hopper 53 is supplied to the developer container 50. In the case where the toner in the toner hopper 53 is depleted as the result of being supplied to the developer container 50, the fact is indicated as an error. In refilling the toner, the old toner hopper 53 depleted of the toner is replaced by a toner hopper 53 filled with new toner. The interior of the toner hopper 53 is segmented into two chambers by a wall 53-1. One of the chambers is filled with new toner and the other chamber is empty before the toner hopper 53 is mounted. When the toner hopper 53 is mounted on the apparatus, the waste toner recovered by the toner cleaner 46 is recovered and stored in the empty chamber through a screw conveyor 48. By replacing the toner hopper 53, therefore, the new toner can be refilled while at the same time disposing of the waste toner. The screw conveyor 48 includes a screw arranged in a recovery pipe, whereby the toner is conveyed.

When the developing unit 42 is mounted in the apparatus, the exposed surface of the developing roller 52, i.e. the sleeve is placed in opposed relation with the surface of the carrier such as the photosensitive member carrying the electrostatic latent image. The bottom wall portion of the developer container 50 makes up a developer pool, in which a reset roller 54 is arranged. The reset roller 54 is rotatably supported by the two side wall portions of the developer container 50 and, when the developing unit 42 is in operation, is rotationally driven in the direction of the arrow. The reset roller 54 recovers the developer that remains on the developing roller 52 without being supplied to the photosensitive member 36.

With the rotation of the developing roller 52, the developer is conveyed to the developing area opposed to the photosensitive member 36. In order to maintain a predetermined amount of the developer conveyed to the developing area by the developing roller 52, a developer control blade 56 is mounted on the lower side of the developing roller 52 in an opposed relation to the photosensitive member 36.

The following process is carried out in the developing unit 42. In the case where the toner component of the developer is charged negatively, for example, an area uniformly charged negatively by the precharger 38 is formed on the rotational surface of the photosensitive member 36. Once the charged area of the photosensitive member 36 is irradiated with the LED beam emitted from the optical head 40, the negative charge is released from the irradiated portion and thereby a potential difference occurs. In other words, an electrostatic latent image is written in the charged area of the photosensitive member 36 as a potential difference. Assuming that the potential of the charged area of the photosensitive member 36 is −600 volts, for example, the potential of the electrostatic latent image 52 is lowered to about −15 volts. On the other hand, the developing roller 52 is impressed with a negative developing bias voltage of, say, −400 volts, so that an electric field is formed between the developing roller 52 and the photosensitive member 36. The toner component charged negatively flies toward the photosensitive member 36 due to the electric field between the developing roller 52 and the photosensitive member 36. The toner component thus is attached and is used for development on the photosensitive member 36.

As the paper sheet P is introduced from the driven roller **24*b* of the belt conveyor means 10 to the printing unit and passes through the print assemblies 20Y, 20M, 20C and 20B sequentially, as shown in FIG. 1, therefore, the paper sheet P is formed with toner images of four colors in superposed relation thereby to form a full-color image. Then, the paper sheet P is fed from the drive roller 24*a* of the belt conveyor means toward the fixing unit 32** of a heat-roller type where the full-color image is thermally fixed on the paper sheet P.

In each of the print assemblies 20Y, 20M, 20C and 20B, the photosensitive member 36, the charger 38, the developing unit 42 and the toner cleaner 46 are formed in a single development unit, and each development unit is replaceably mounted on the frame 12. The optical head 40 is mounted on the top cover 14. The paper conveyor belt 22 and the rollers **24*a* to 24*d* are integrated as a belt unit, and the transfer element 44** is mounted on the belt unit.

Figure 7:
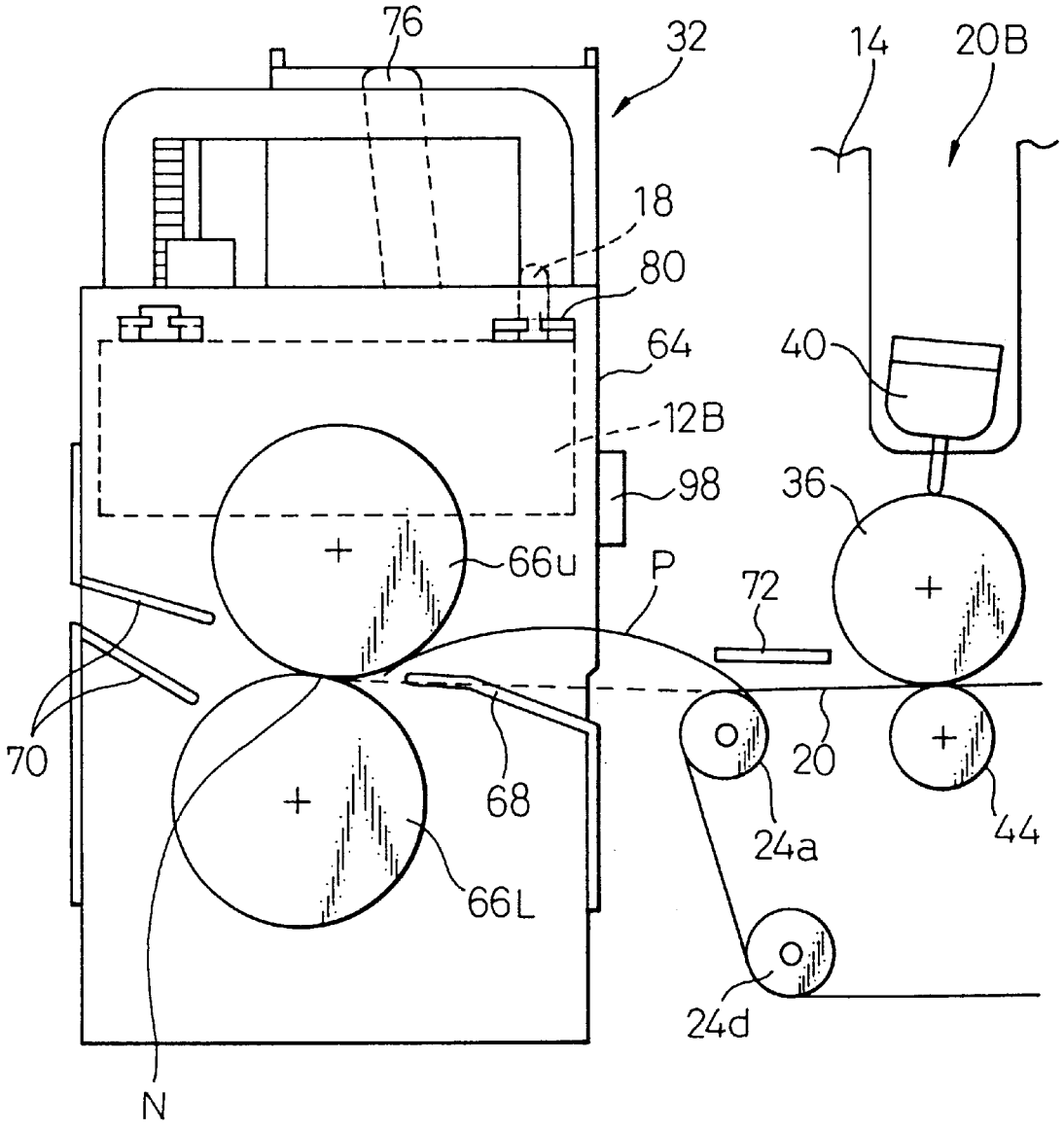
FIG. 7 is a schematic side view showing a part of the paper sheet conveyor belt and the fixing unit.

FIG. 7 is a schematic side view showing a part of the paper sheet conveyor belt 22 and the fixing unit 32. The fixing unit 32 includes a case 64, an upper fixing roller 66U and a lower fixing roller 66L. The upper fixing roller 66U and the lower fixing roller 66L are arranged in parallel contact with each other to form a nip N between the upper fixing roller 66U and the lower fixing roller 66L. The upper fixing roller 66U and the lower fixing roller 66L each have a built-in heat source such as a halogen lamp and are adapted to be heated to 170 to 190° C., for example. Thermistors 67U and 67L (FIG. 12) are arranged to detect the temperature of the roller surface. A high pressure of, say, 33 atmosphers is applied between the upper fixing roller 66U and the lower fixing roller 66L. The paper sheet is fixed at a high temperature and under a high pressure between the fixing rollers 66U and 66L.

A drive motor (not shown) is provided for driving the fixing rollers 66U and 66L of the fixing unit 32, separately from a drive motor (not shown) for driving the paper sheet conveyor belt 22, so that the sheet conveying speed of the fixing rollers 66U and 66L is lower than that of the paper sheet conveyor belt 22. As a result, the forward end of the paper sheet is nipped by the fixing rollers 66U and 66L, while the rear end of the paper sheet is attracted to the paper sheet conveyor belt 22 and thus the paper sheet is curved with respect to a straight line connecting the outlet end of the paper sheet conveyor belt 22 and the nip N of the fixing rollers 66U and 66L by an amount corresponding to the overfeed.

The fixing unit 32 includes an inlet-side paper guide 68 and an outlet-side paper guide 70. An upper guide 72 is arranged above the outlet end portion of the paper sheet conveyor belt 22. The inlet-side paper guide 68 (the forward end portion thereof) is located slightly above the straight line (indicated by dashed line) connecting the outlet end portion of the paper sheet conveyor belt 22 and the nip N of the fixing rollers and causes the paper sheet to be curved upward. The curved paper sheet P is shown in FIG. 7. By causing the paper sheet to be curved upward in the cylindrical shape, the rigidity of the paper sheet is increased and the paper sheet does not become fouled in the fixing unit 32.

As described above, a phenomenon, that the rear end portion of the paper sheet jumps up, is observed when the rear end portion of the paper sheet is released from the outlet end portion of the paper sheet conveyor belt 22 with the forward end portion of the paper sheet nipped between the fixing rollers 66U and 66L. The rear end portion of the paper is fouled when it jumps up. In view of this, according to this embodiment, the inlet-side paper guide 68 is formed of a metal plate having elasticity and adapted to move vertically with respect to the paper passage in accordance with the thickness and type of the paper sheet P. When the paper sheet tends to jump up, the inlet-side paper guide 68 is pushed down under the pressure of the paper sheet. In view of the fact that the portion which should make up the supporting point of the paper is lowered when the paper tends to jump up, the force to cause the paper to jump is suppressed thereby to prevent the paper sheet jumping up.

The degree to which the rear end portion of the paper jumps up is small for a thin paper sheet and large for a thick paper sheet. The elastic inlet-side paper guide 68 is elastically deformed to a large degree for a thick paper sheet and to a small degree for a thin paper sheet, with the result that the force to cause the paper to jump is properly reduced. The forward end portion of the inlet-side paper guide 68 is protruded upward by about 2 mm from the straight line connecting the outlet end portion of the paper conveyor belt 22 and the nip of the fixing rollers 66U and 66L. Therefore, the inlet-side paper guide 68 is properly elastically deformed by about 2 mm for the commercially available thick paper (such as a postcard).

Figure 12:
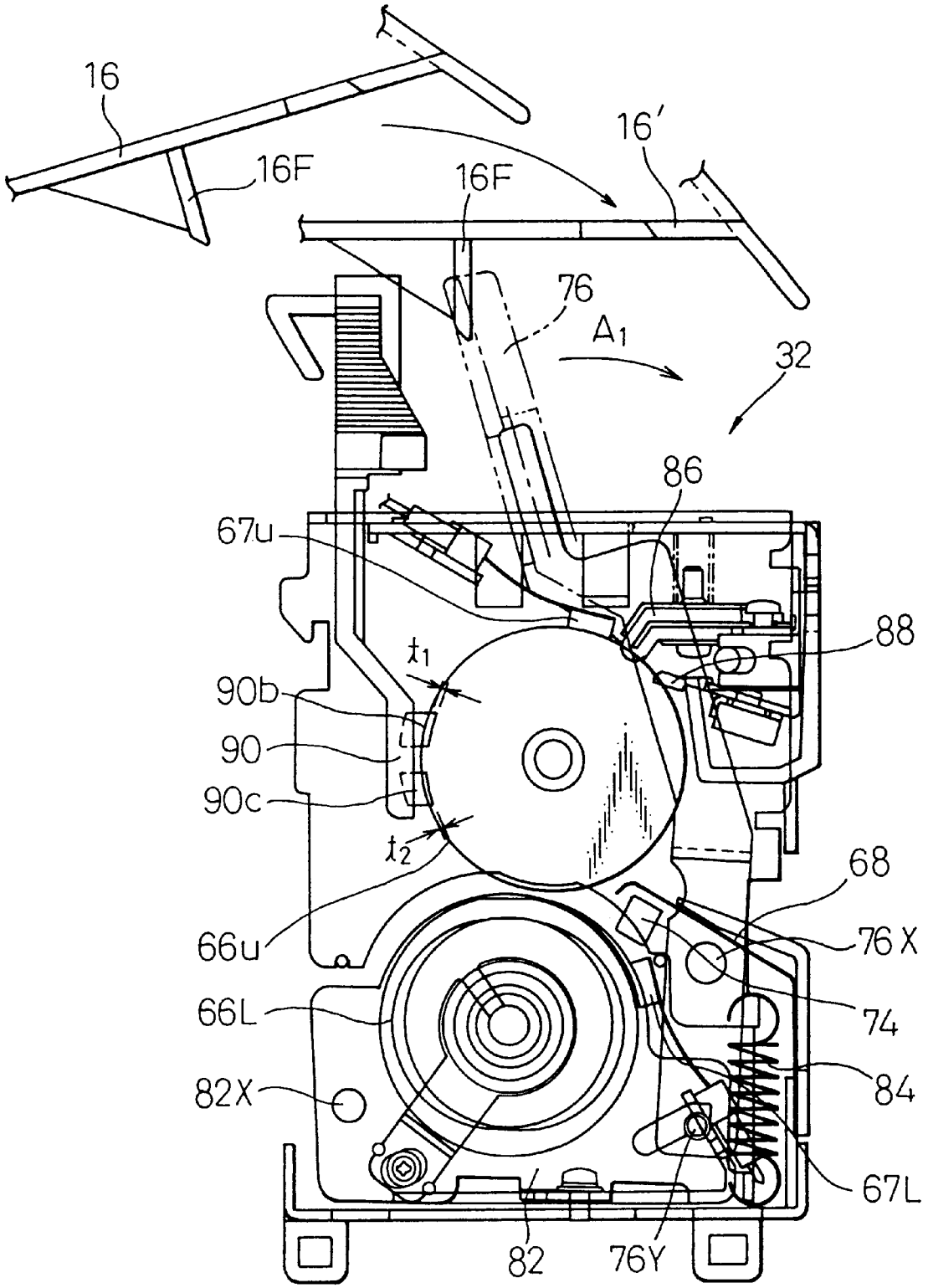
FIG. 12 is a diagram showing the detailed configuration in the fixing unit.
Figure 17:
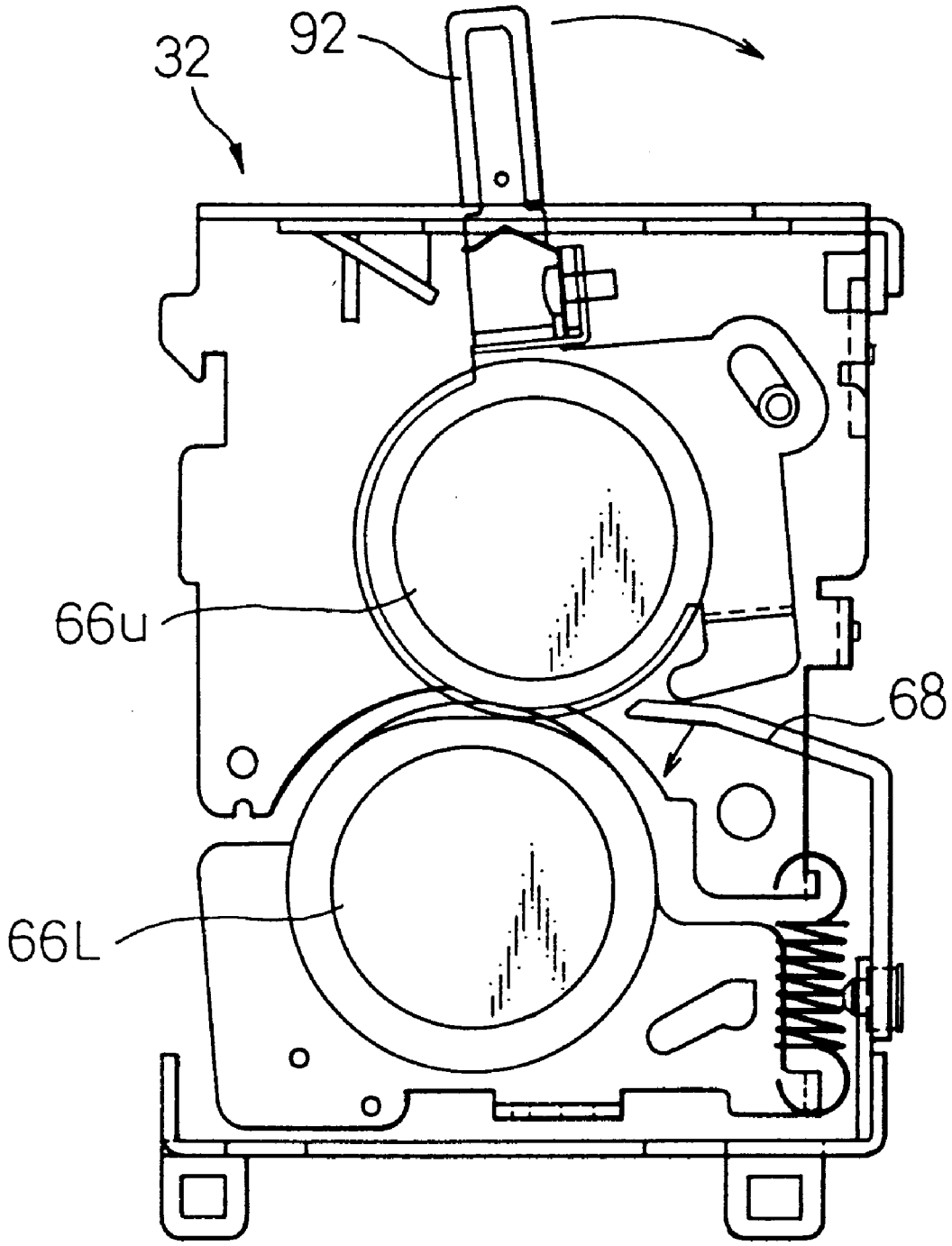
FIG. 17 is a diagram showing an example of the fixing unit having a manually operated paper guide.

This embodiment employs the inlet-side paper guide 68 elastically deformed under the paper pressure. A similar effect can be attained, however, by moving the inlet-side paper guide 68 using drive means in accordance with the type and thickness of the paper. In FIG. 12, for example, an electromagnetic plunger 74 is arranged to move the inlet-side paper guide 68 downward when the paper tries to jump up. A motor or other drive means can be used in place of the electromagnetic plunger 74. The inlet-side paper guide 68, which can be regulated automatically as described above, may also be configured for manual operation (FIG. 17).

Figure 8:
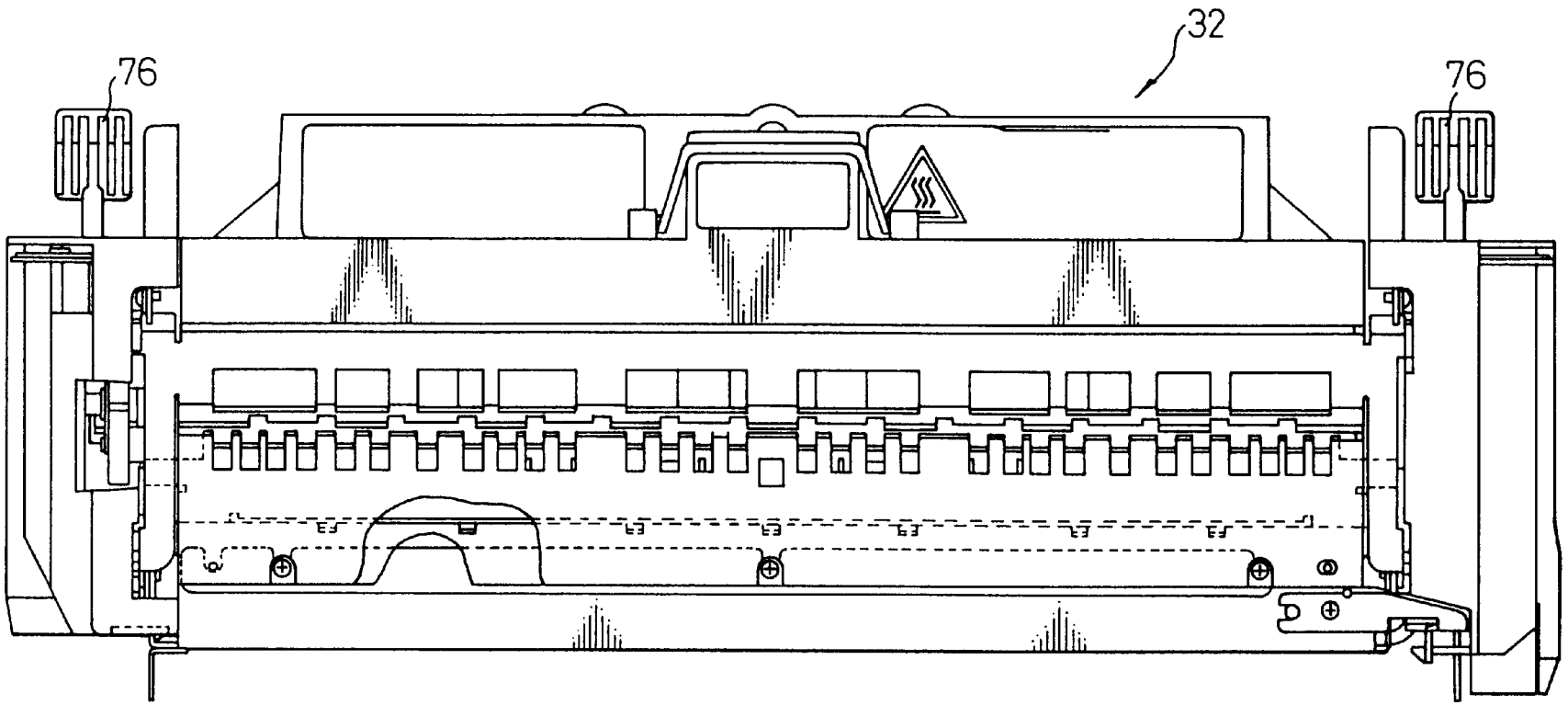
FIG. 8 is a rear view of the fixing unit.
Figure 9:
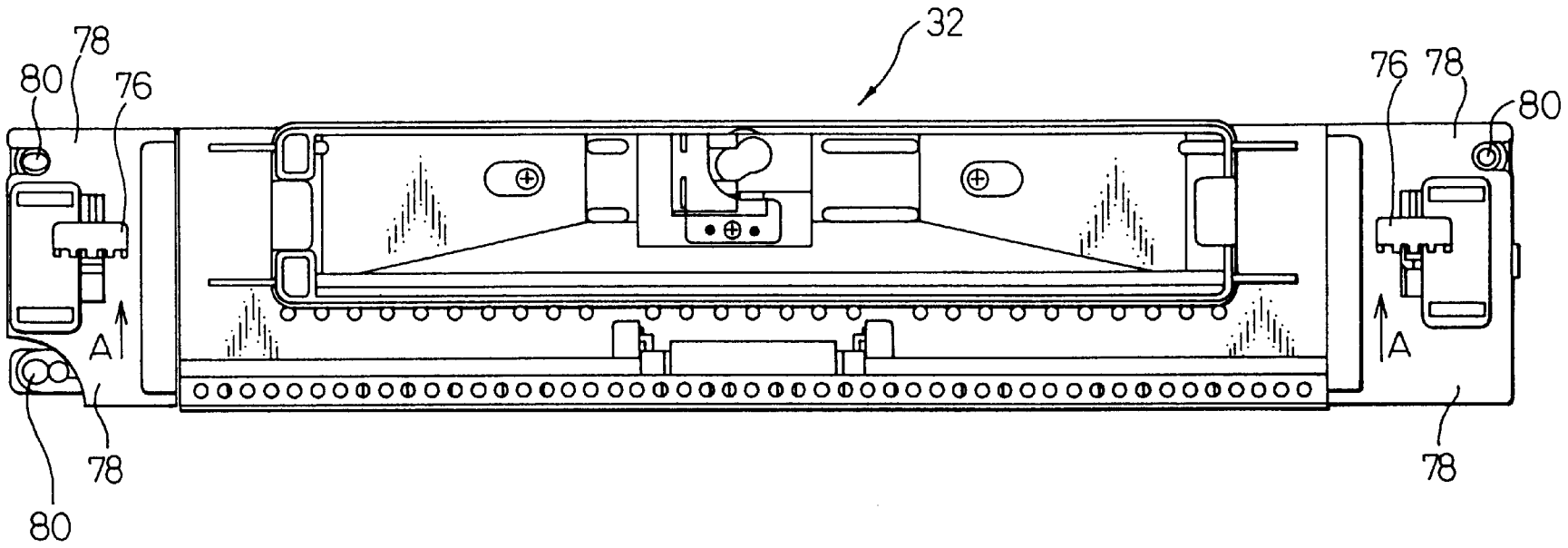
FIG. 9 is a plan view of the fixing unit.

FIG. 8 is a rear view of the fixing unit 32, and FIG. 9 is a plan view of the fixing unit 32. The fixing unit 32 has a pair of nip control levers 76 in proximity to the end portions thereof. The nip control levers 76 are operatively coupled to the lower fixing roller 66L, so that the nip N between the fixing rollers 66U and 66L can be closed when the nip control levers 76 are moved in the direction of arrows A in FIG. 9, while the nip N can be opened between the fixing rollers 66U and 66L when the nip control levers 76 are moved in a direction opposite to the arrows A.

Further, the fixing unit 32 has fixing unit mounting members 78 in proximity to the nip control levers 76. The fixing unit 32 is mounted on the frame 12 at the mounting members 78. The mounting members 78 have holes 80 for inserting the positioning pins 18 shown in FIGS. 4 and 5. As shown in FIG. 9, the mounting members 78 of the fixing unit 32 are arranged at the four corners of the fixing unit 32, but the holes 80 for inserting the positioning pins 18 are arranged at three corners, and the remaining one corner has no hole. However, a hole 80 for inserting the positioning pin 18 can be formed at the remaining one corner. Alternatively, such holes can be formed at the two side corners.

The mounting members 78 of the fixing unit 32 are supported by the support members 12B of the frame 12 shown in FIGS. 4 and 5. Thus, by placing the fixing unit 32 on the support members 12B of the frame 12 while inserting the positioning pins 18 into the holes 80, the fixing unit 32 can be mounted snugly on the frame 12. The positioning pins 18 and the support members 12B are shown also in FIG. 7. The fixing unit 32 is fixed on the frame 12, not by screws as in the prior art, but by use of the nip control levers 76 and the positioning pins 18, as described below.

Figure 10:
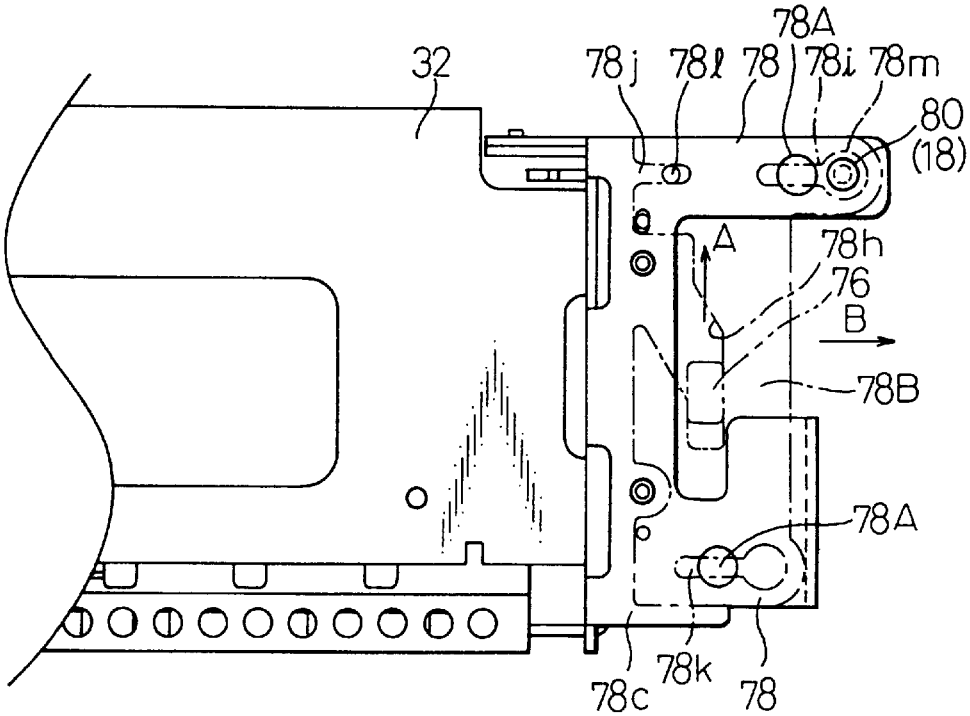
FIG. 10 is a plan view showing a part of the fixing unit, with the cover omitted.
Figure 11:
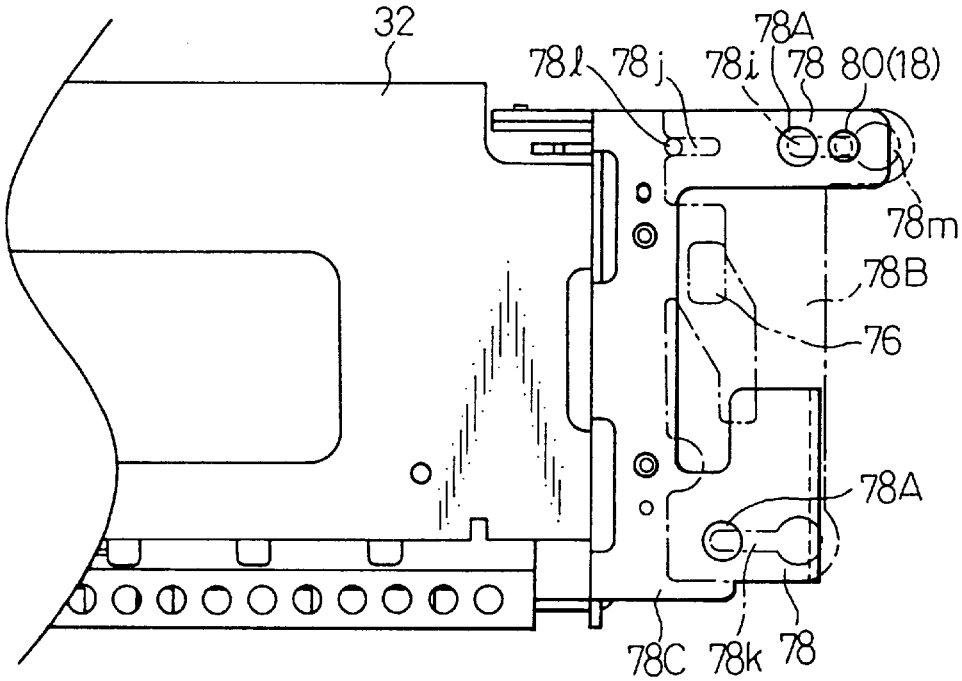
FIG. 11 is a diagram showing the fixing unit of FIG. 10 in the nip position.

FIG. 10 is a plan view showing a part of the fixing unit 32 with the cover thereof removed, and FIG. 11 is a diagram showing the fixing unit 32 of the FIG. 10 in the nipped state. As shown in FIG. 5, the mounting members 78 of the fixing unit 32 include members 78A, 78B and 78C. The member 78A is formed as a grooved stud or a headed pin. The members 78B and 78C are plate members. The members 78A and 78C are secured on the fixing unit 32, and the central member 78B is sandwiched between the members 78A and 78C and formed as a cam plate movable relative to the members 78A and 78C.

As shown in FIGS. 10 and 11, the central plate member 78B has a cam portion 78*h*, a lock hole 78*i* and guide slots 78*j* and 78*k*. The guide slots 78*j* and 78*k* extend in the direction perpendicular to the direction of arrows A in which the nip control levers 76 are moved. The pins 78*l* and 78A formed on the members 78C are inserted into the guide holes 78*j*, 78*k* and 78*i*. As a result, the central plate member 78B is guided movably in the direction perpendicular to the direction of arrows A in which the nip control levers 76 are moved.

The cam portion 78*h* extends in the direction substantially parallel to the arrows A of the nip control levers 76 and has an inclined surface portion. When the nip control levers 76 engage the cam portion 78*h* and move in the direction of arrow A, the central plate member 78B is moved in the direction of arrow B perpendicular to the direction of arrow A.

A lock hole 78*i* is a long slot extending in the same direction as the guide holes 78*j* and 78*k*, and has an enlarged portion 78*m* at an end thereof. The enlarged portion 78*m* of the lock hole 78*i* is in registration with the hole 80 for inserting the positioning pin 18 in the state shown in FIG. 10. The enlarged portion 78*m* of the guide holes 78*j* and 78*k* is shown in FIG. 5 and has the same diameter as the hole 80 of the member 78C.

As shown in FIG. 5, the positioning pin 18 has a small-diameter portion 18*a* in the longitudinal middle portion thereof. The small-diameter portion 18*a* of the positioning pin 18 is located at the same height as the central plate member 78B. The diameter of the positioning pin 18 is substantially the same as that of the holes 80 of the plate members 78A and 78C, so that the fixing unit 32 can be set in position by the positioning pin 18. The diameter of the small-diameter portion 18*a* of the positioning pin 18 is substantially the same as the width of the lock slot 78*i*.

Thus, when the nip control levers 76 are in the nip open position as shown in FIG. 10, the positioning pins 18 can be inserted into the aligned holes 80 of the plate members 78C and the enlarged portion 78*m* of the lock hole 78*i* of the plate member 78B. When the nip control levers 76 are moved in the direction of arrow A from the position shown in FIG. 10, the central plate member 78B is moved in the direction of arrow B into the state of FIG. 11. In FIGS. 10 and 11, the movement of the central plate member 78B causes the small-diameter portion 18*a* of the positioning pin 18 to move along the lock hole 78*i* so that the upper and lower annular walls of the small-diameter portion 18*a* of the positioning pin 18 come to engage the side wall of the lock hole 78*i*. In this way, the fixing unit 32 is locked or secured to the frame 12 while the mounting portion 78 is kept within the positioning pin 18.

In removing the fixing unit 32 from the frame 12, the nip control levers 76 are moved in the direction opposite to the arrows A from the position of FIG. 11. Then, the central plate member 78B moves in such a manner that each of the holes 80 of the plate member 78C and the enlarged portion 78*m* of the lock hole 78*i* of the plate member 78B are aligned. Then, in removing the fixing unit 32 from the frame 12, the positioning pin 18 comes off from the aligned holes.

Figure 13:
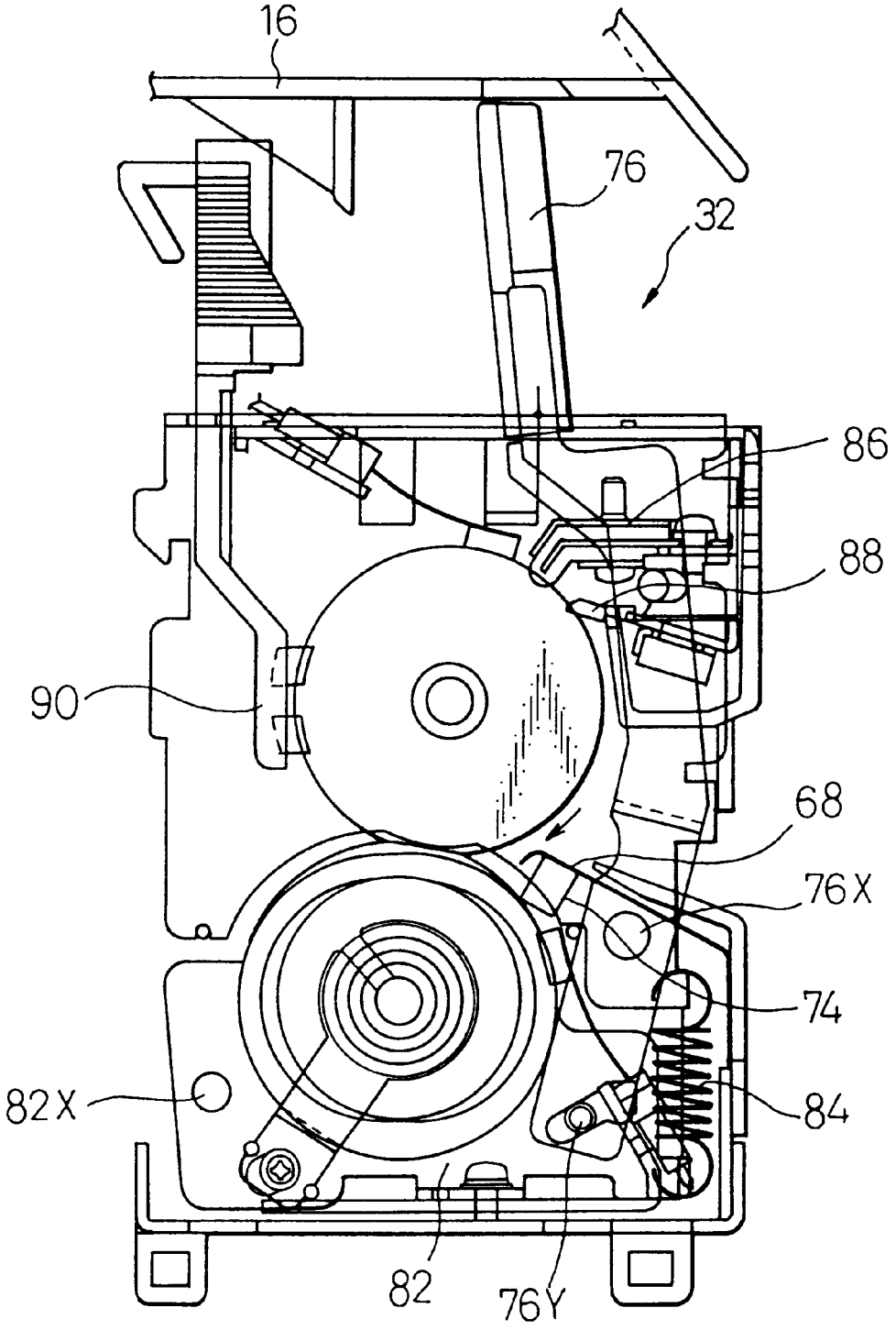
FIG. 13 is a diagram showing the fixing unit of FIG. 12 in the nip position.

FIGS. 12 and 13 show various members in the fixing unit 32. The upper fixing roller 66U is substantially supported at a fixed position, while the lower fixing roller 66L is movable vertically with respect to the upper fixing roller 66U. For this reason, the lower fixing roller 66L is supported by a support member 82 which is pivotally coupled to the frame 12 at the pivotal support member 82X. The pivotal support member 82 is urged by a spring 84 so that the lower fixing roller 66L is in contact with the upper fixing roller 66U. The nip control levers 76 are pivotally coupled to the frame 12 at the pivotal support member 76X and pivotally coupled to the support member 82 at the pivotal support member 76Y.

Thus, when the nip control levers 76 are moved in the direction of arrow A1 in FIG. 12, the lower fixing roller 66L moves down away from the upper fixing roller 66U against the force of spring 84 and thus is brought into the nip open position shown in FIG. 13. Under this condition, the force of the spring 84 acts in the nip open direction. When the nip control levers 76 are moved in the opposite direction from the position of FIG. 13, on the other hand, the lower fixing roller 66L moves up into the nip position shown in FIG. 12 at which it comes into contact with the upper fixing roller 66U. Under this condition, the force of the spring 84 is exerted in the direction to close the nip.

Further, as shown in FIGS. 1, 12 and 13, the end cover 16 has a lever drive piece 16F. The lever drive piece 16F is arranged in such a manner that when the end cover 16 is moved from the open position to the close position, the end cover 16 comes into contact with the nip control levers 76 remaining in the open position and drives the nip control levers 76 into the nip position.

It is possible to remove the fixing unit 32 from the frame 12 for carrying out work, by opening the end cover 16 and operating the nip control levers 76 to open the nip of the fixing rollers 66U and 66L. Further, after that, the image can be formed by mounting the fixing unit 32 on the frame 12, operating the nip control levers 76 to close the nip of the fixing rollers 66U, 66L and closing the end cover 16. Even if, after mounting the fixing unit 32 on the frame 12, the end cover 16 is closed while forgetting the operation of the nip control levers 76 to close the nip of the fixing rollers 66U and 66L, the lever drive piece 16F of the end cover 16 comes into contact with the nip control levers 76 and drives the nip control lever 76 into the nip position. In FIG. 12, the end cover is shown in the open position and the end cover 16' is shown in the process of being closed. In FIG. 13, the end cover 16 is shown in the closed position.

Further, in FIGS. 12 and 13, an oil supply unit 86, an oil blade 88 and a cleaning unit 90 are arranged with respect to the upper fixing roller 66U located on the side of the image-forming surface of the paper sheet P. The oil supply unit 86 and the oil blade 88 are arranged upstream of the nip, and the cleaning unit 90 is arranged downstream of the nip as viewed in the direction of rotation of the fixing roller 66U. The oil supply unit 86 is provided to prevent the paper sheet P from being stuck to the fixing roller 66U by coating oil on the upper fixing roller 66U. The oil blade 88 scrapes off the extra oil coated by the oil supply unit 86 into a uniform state. The cleaning unit 90 is for cleaning off the residual toner or the like attached to the upper fixing roller 66U.

Figure 14:
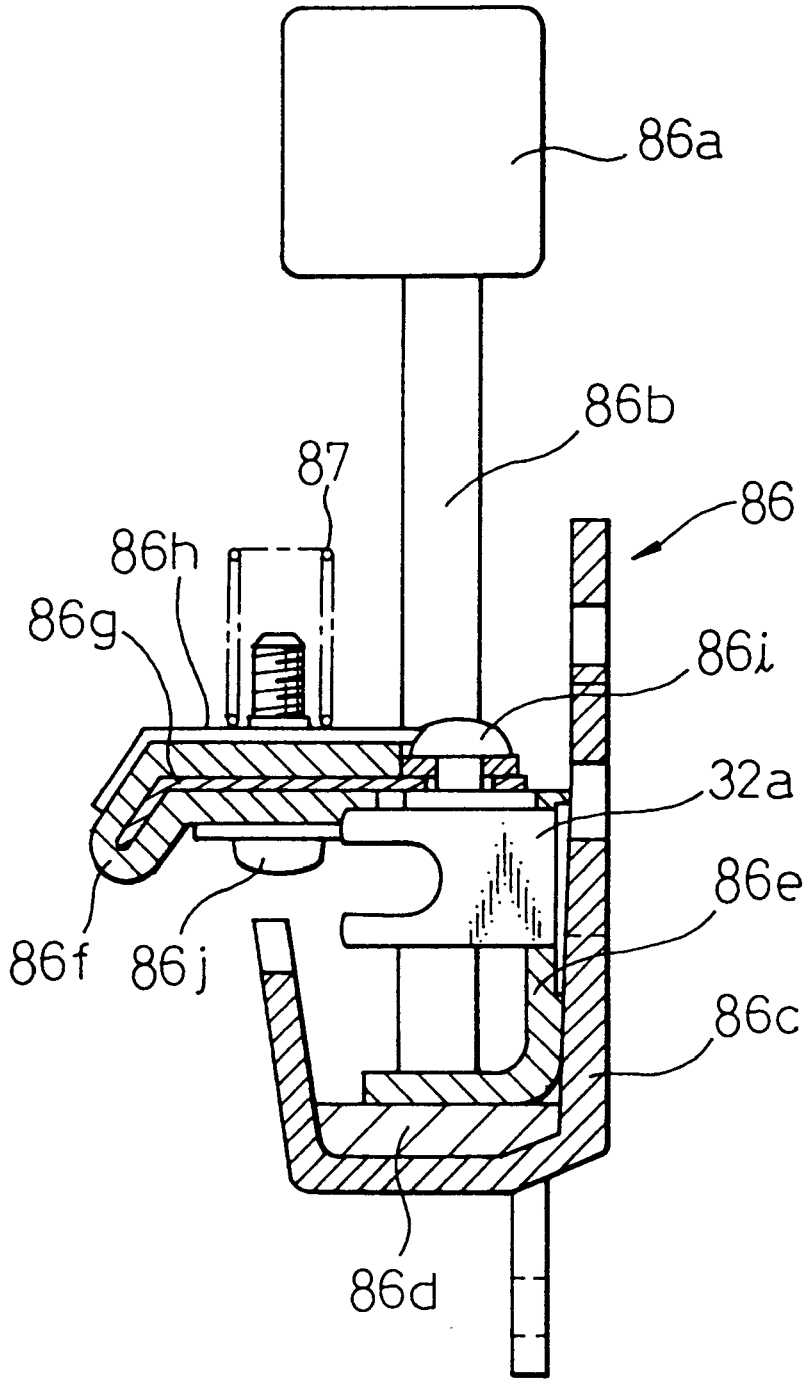
FIG. 14 is a sectional view of the oil supply unit.
Figure 15:
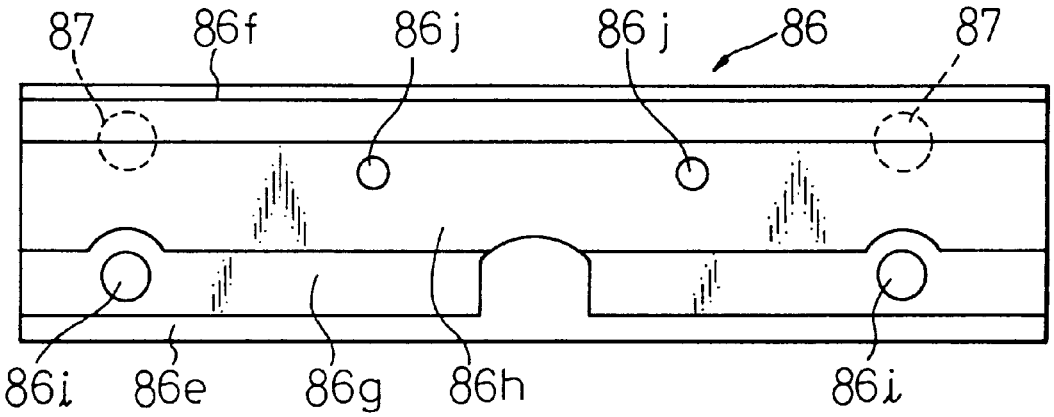
FIG. 15 is a plan view showing the oil supply felt of FIG. 14.

FIGS. 14 and 15 show the oil supply unit 86 in detail. The oil supply unit 86 includes an oil tank 86*a* arranged above the fixing unit 32, an oil tube 86*b*, a reservoir felt 86*d* arranged in the oil reservoir container 86*c* and an oil supply felt 86*e* arranged in contact with the reservoir felt 86*d*.

The oil tube 86*b* extends downward of the oil tank 86*a* into contact with the reservoir felt 86*d*. Thus, the oil always stays in the reservoir felt 86*d*. The oil supply felt 86*e* includes a vertical portion in contact with and extending upward from the reservoir felt 86*d*, a first horizontal portion bent substantially at right angles from the vertical portion and a second horizontal portion bent in the shape of a hair pin from the first horizontal portion. The portion 86*f* bent in the shape of the hair pin is in contact with the upper fixing roller 66U.

A support plate 86*g* is inserted between the first horizontal portion and the second horizontal portion of the oil supply felt 86*e*, and the securing plate 86*h* is arranged on the second horizontal portion. The support plate 86*g* is mounted by a screw 86*i* on a bracket 32*a* which in turn is mounted on the fixing unit 32. The hole of the support plate 86*g* and the screw 86*i* have a play therebetween, and therefore the support plate 86*g* is movably mounted on the bracket 32*a* so that the oil supply felt 86*e* is movably supported, within an allowable range, on the fixing unit 32. The securing plate 86*h* integrates the support plate 86*g* and the first horizontal portion and the second horizontal portion of the oil supply felt 86*e* with a screw 86*j*.

Springs 87 are arranged in such a position as to urge the securing plate 86*h* downward. Therefore, the oil supply felt 86*e* of the oil supply unit 86 is urged to the upper fixing roller 66U by the elasticity of the springs 87. In the embodiment, the two springs 87 are arranged at positions in the vicinity of the ends of the oil supply felt 86*e*. In this way, the oil supply felt 86*e* is urged to the upper fixing roller 66U by the elasticity of the spring 87, and therefore the contact pressure of the oil supply felt 86*e* against the upper fixing roller 66U is not varied from one place to another so that the oil is attached uniformly to the upper fixing roller 66U.

Figure 16:
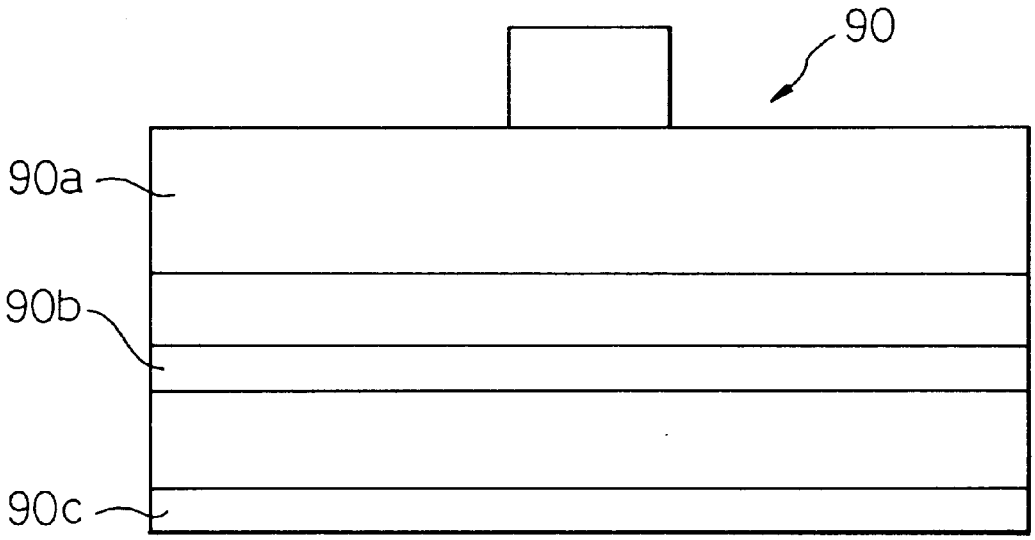
FIG. 16 is a plan view showing the cleaning unit of FIG. 12.

As shown in FIGS. 12 and 16, the cleaning unit 90 includes a felt support member 90*a* and two felts 90*b*, 90*c*. The felt support member 90*a* is properly mounted on the fixing unit 32. The two felts 90*b*, 90*c* are mounted on the felt support member 90*a* in such a manner as to contact the upper fixing roller 66U. According to this embodiment, the pressure under which the felt 90*b* is in contact with the upper fixing roller 66U is different from the pressure under which the felt 90*c* is in contact with the upper fixing roller 66U. The pressure under which the felts 90*b*, 90*c* are contact with the upper fixing roller 66U, for example, are indicated by the deformation thickness $t_1$, $t_2$ of the felts 90*b*, 90*c*, respectively, in contact with the upper fixing roller 66U, and the difference in deformation thickness between the two felts 90*b* and 90*c* ($t_1$–$t_2$) is about 1 mm.

The pressure under which the felt 90*c* first comes into contact with the upper fixing roller 66U is lower than the pressure under which the felt 90*b* later comes into contact with the upper fixing roller 66U. In this way, the two felts 90*b* and 90*c* can substantially equally clean the residual toner or the like attached on the upper fixing roller 66U, thereby preventing one of the felts from being fouled earlier than the other. If the two felts 90*b* and 90*c* are mounted under the same contact pressure, the felt 90*c* coming first into contact with the upper fixing roller 66U cleans an excessively large proportion of the residual toner and the like and is fouled earlier, resulting in a shorter service life of the fixing rollers as a whole.

Figure 18:
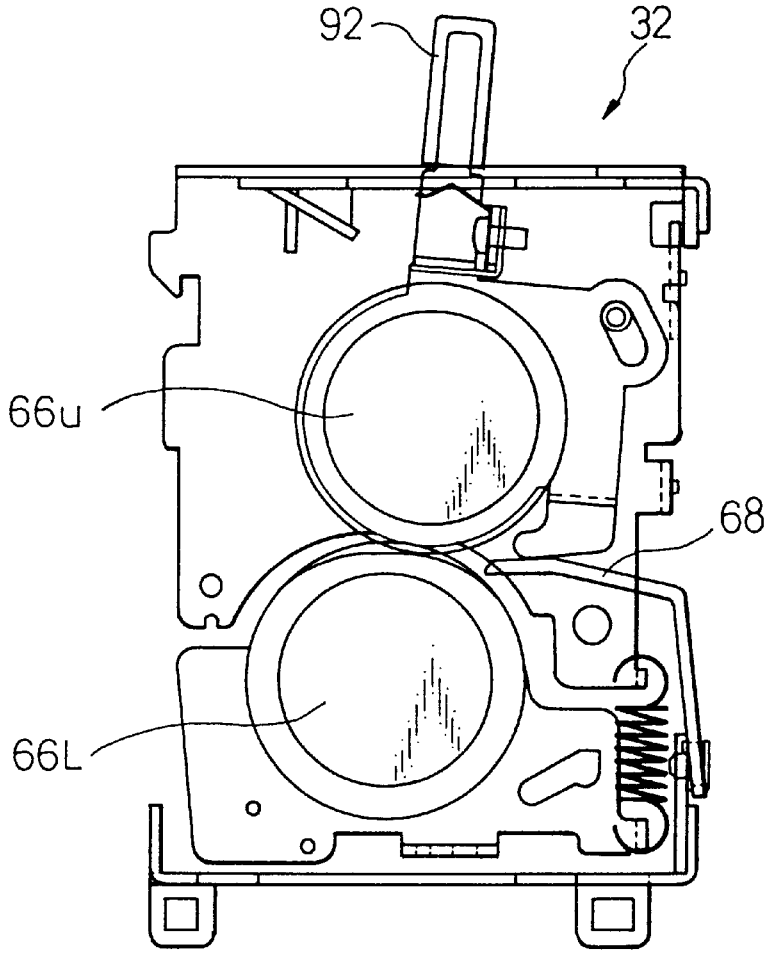
FIG. 18 is a diagram showing the fixing unit with the paper guide of FIG. 17 at a lower position.
Figure 19:
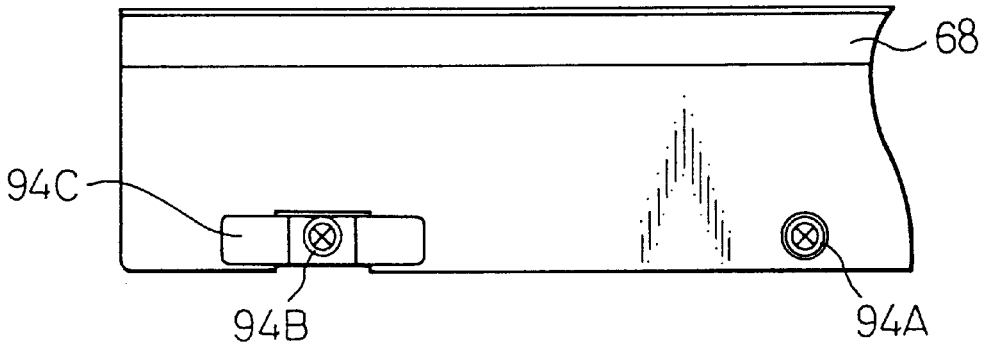
FIG. 19 is a plan view showing the fixing unit of FIG. 17.

FIGS. 17 to 19 are diagrams showing an example in which the inlet-side paper guide 68 can be manually operated. In the case, a manual lever 92 is mounted on the fixing unit 32 for manually operating the inlet-side paper guide 68. As shown in FIG. 17, the forward end portion of the lever 92 is in substantial contact with the inlet-side paper guide 68, and the forward end portion of the inlet-side paper guide 68 is located slightly above the nip between the two fixing rollers. As shown in FIG. 18, when using thick paper liable to be curled up, the forward end portion of the inlet-side paper guide 68 is slightly lowered by operating the lever 92. As a result, the paper is prevented from curling up.

The inlet-side paper guide 68, if comparatively hard, can be rendered to move in its entirety. As shown in FIG. 19, the inlet-side paper guide 68 is mounted on the fixing unit 32 by a screw 94A with a play at almost the central portion thereof, and by a spring plate 94B and a screw 94C at an outer portion thereof. Thus, the inlet-side paper guide 68, when depressed by the forward end portion of the lever 92, can be displaced by the elastic deformation of the spring plate 94B and the play around the screw 94A.

Figure 20:
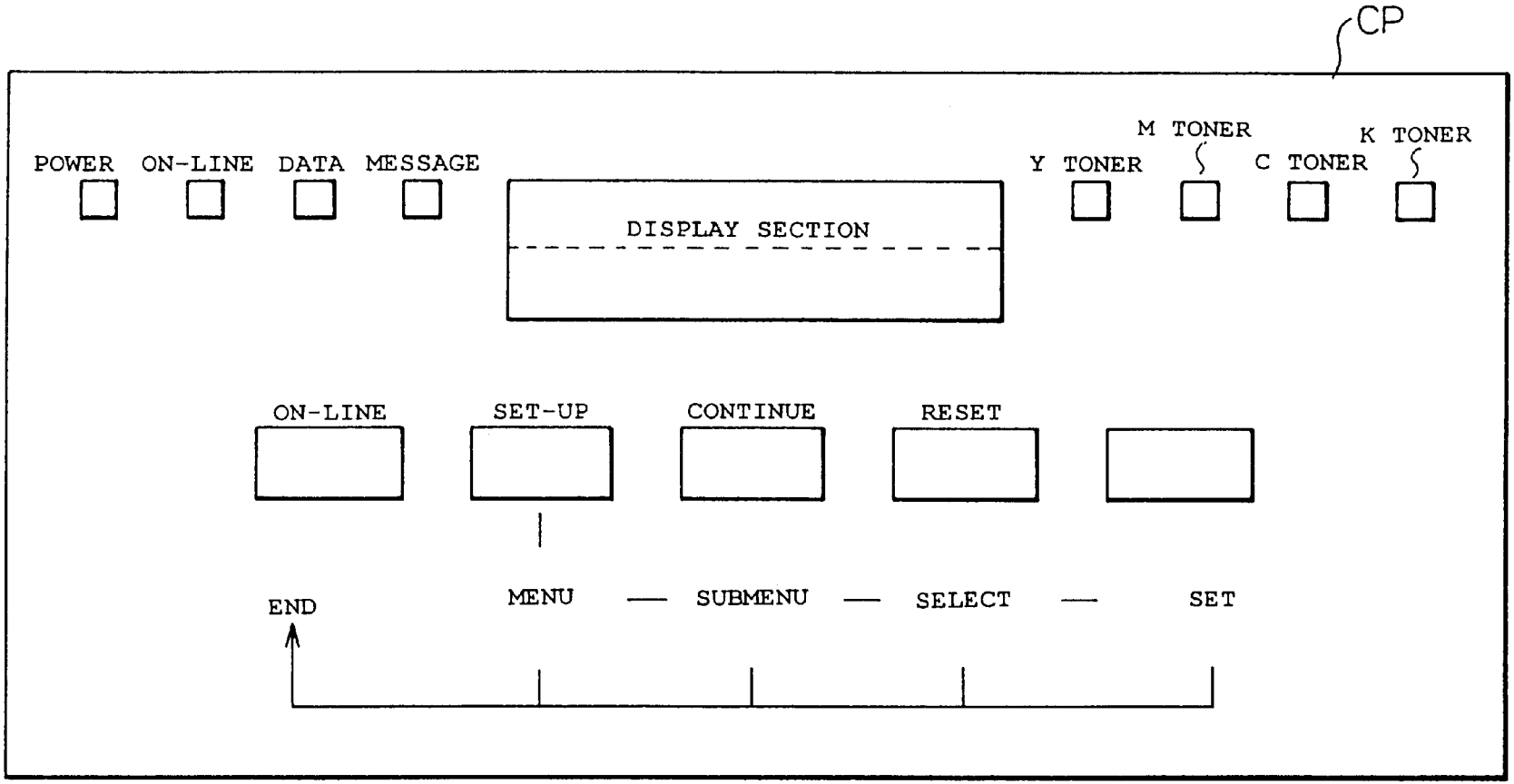
FIG. 20 is a diagram showing the control panel.

FIG. 20 is a diagram showing an example of the control panel CP (FIG. 3) arranged on the frame 12 of the image forming apparatus 10. The control panel CP has the function of controlling the speed of the fixing rollers 66U and 66L in accordance with the type of the paper or the processing mode. As described above, the speed at which the paper is conveyed by the fixing rollers 66U and 66L is lower than the speed at which the paper is conveyed by the paper conveyor belt 22, so that the paper P is conveyed while being curved between the paper sheet conveyor belt 22 and the fixing rollers 66U and 66L as shown in FIG. 7. When the paper sheet leaves the outlet end portion of the paper sheet conveyor belt 22, the rear end portion of the curved paper sheet jumps up and the paper sheet is fouled. According to this embodiment, therefore, the inlet-side paper guide 68 is adapted to move down.

If the paper feed rate of the fixing rollers 66U and 66L is the same as that of the paper sheet conveyor belt 22, the paper would not be curved and the problem of jumping up would be obviated. Nevertheless, the drive motor of the fixing rollers 66U and 66L is separate from that of the paper sheet conveyor belt 22, and the paper feed operation of the fixing rollers 66U and 66L changes in accordance with the change of the roller diameter due to the heat of the fixing rollers and the type of the paper sheet. Therefore, the paper feed rate of the fixing rollers 66U and 66L cannot be the same as that of the paper conveyor belt 22. Hence, the speed at which the paper is fed by the fixing rollers 66U and 66L is set at an optimum value lower than the speed at which the paper is conveyed by the paper conveyor belt 22. The speed at which the paper sheet is fed by the fixing rollers 66U and 66L can be regulated at this optimum setting.

Figures 21, 22:
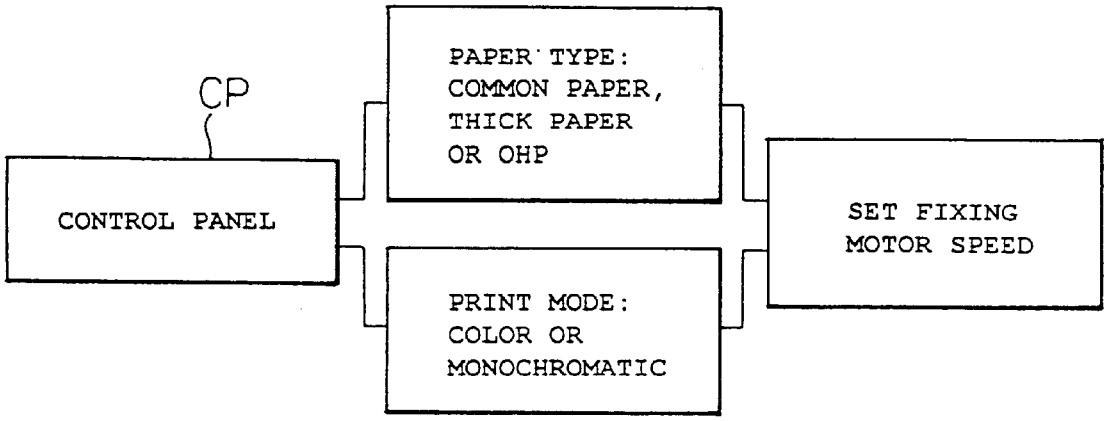
FIG. 21 is a block diagram showing an example of speed control of the fixing rollers.
FIG. 22 is a diagram showing an example of selected values used for speed control of the fixing rollers.

FIG. 21 is a block diagram showing an example of speed control of the fixing rollers. In FIG. 21, the speed of the drive motor of the fixing rollers 66U, 66L can be set appropriately in accordance with the type of paper and the printing mode.

In FIG. 20, for example, the control panel CP includes an on-line button, a set-up button, a continue button and a reset button. For setting the speed of the fixing rollers 66U, 66L, the special mode is used. To attain the special mode, power is switched on while depressing two of these buttons at the same time. In the shown example, the buttons shown in the lower part of FIG. 20 are displayed.

Upon depression of the menu button, the color mode is displayed, while upon depression of the select button, a selected value is displayed as shown in FIG. 22. The selected value 5 corresponds to the initial value determined based on the optimum setting described above. For the selected value of more than 5, the speed increases by 0.25% of the initial value. For the selected value of smaller than 5, on the other hand, the speed decreases by 0.25% of the initial value.

The color mode indicates that the paper of standard thickness is printed in color. A value suitable for this mode is selected and set by the set button. Then, upon depression of the menu button, the thick paper mode is displayed. The thick paper mode indicates that a paper (120 kg, for example) considerably thicker than a paper of standard thickness is printed in color, in which case a suitable value is selected and set by the set button. Further, upon depression of the menu button, the OHP mode is displayed. The OHP mode indicates the OHP is printed in color, so that a value suitable for this mode is selected and set by the set button. Upon another depression of the menu button, the monochromatic mode is displayed. A value suitable for this mode is selected and set by the set button. In this way, the speed of the drive motor of the fixing rollers 66U, 66L is set.

Figure 23:
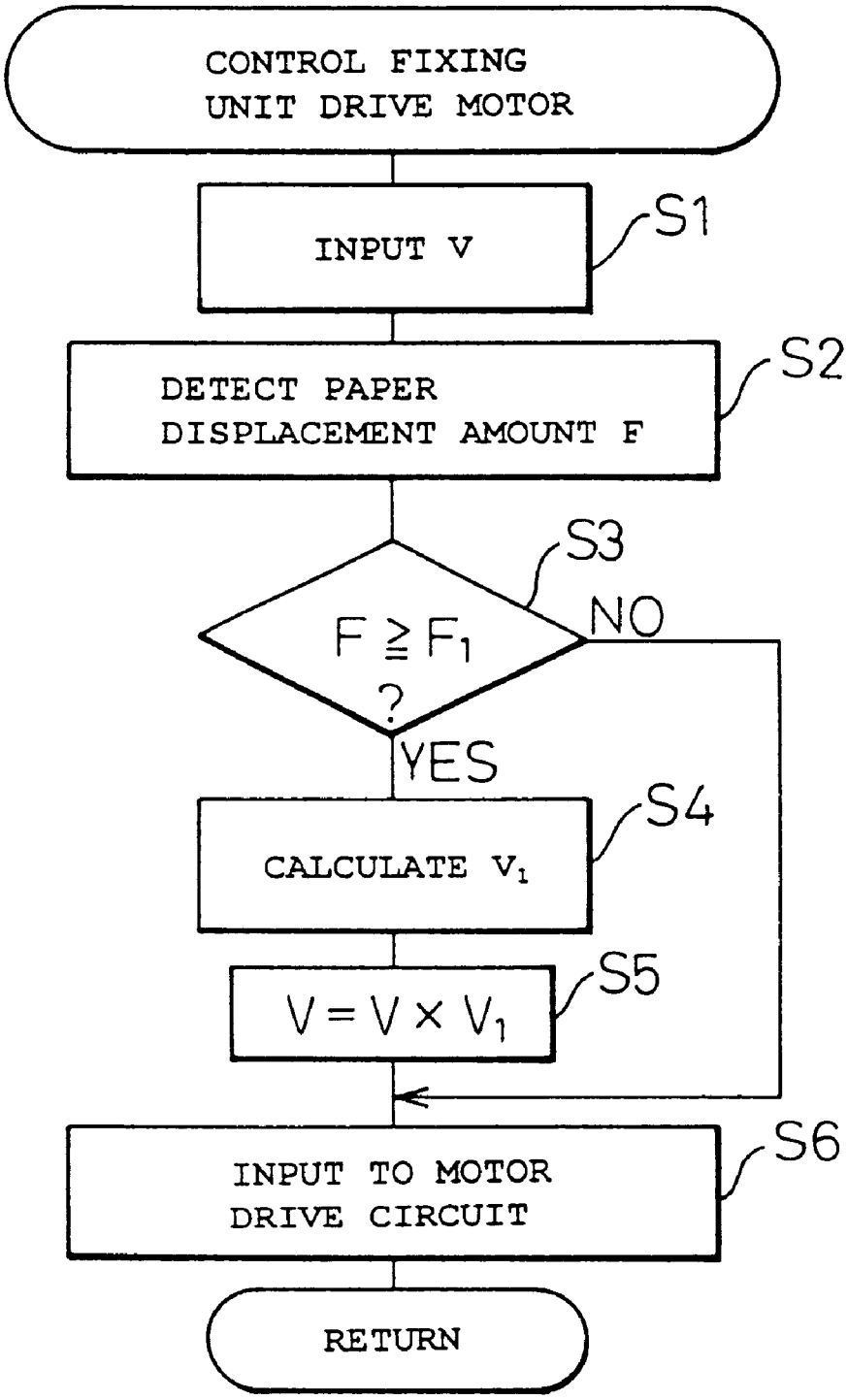
FIG. 23 is a flowchart showing an example of the speed control of the fixing rollers.

FIG. 23 is a flowchart showing an example of setting the speed of the drive motor of the fixing rollers 66U, 66L automatically using a displacement sensor. As shown in FIG. 7, the displacement sensor 98 is arranged above the passage of the paper, for example, for detecting the amount of displacement of the paper P by measuring the distance to the paper P without contact.

In step S1 of FIG. 23, the speed value V of the drive motor of the fixing rollers 66U, 66L is input. This speed value v is the aforementioned optimum setting for starting the operation in the initial stage of operation of the apparatus. This value is subsequently corrected based on the optimum setting and constitutes the value stored on the immediately preceding occasion. In step S2, the displacement amount F of the paper P is detected by a non-contact sensor 98. In step S3, it is determined whether the detected displacement amount F of the paper P is larger than a predetermined value $V_1$ or not. If the result is YES, the process proceeds to step S4 for calculating the speed change rate $V_1$. The speed change rate $V_1$, like the selected value of FIG. 22, for example, is stored in a computer as a table of functions of the displacement amount. In step S5, the speed value V is determined as the product of the speed value V and the speed change rate $V_1$. In step S6, the speed value V thus corrected is input to the motor drive circuit for changing the rotational speed of the fixing rollers 66U, 66L. In the case where the result of step S3 is NO, the speed value V not corrected is input to the motor drive circuit for driving the fixing rollers 66U, 66L at the same rotational speed as before.

Figure 24:
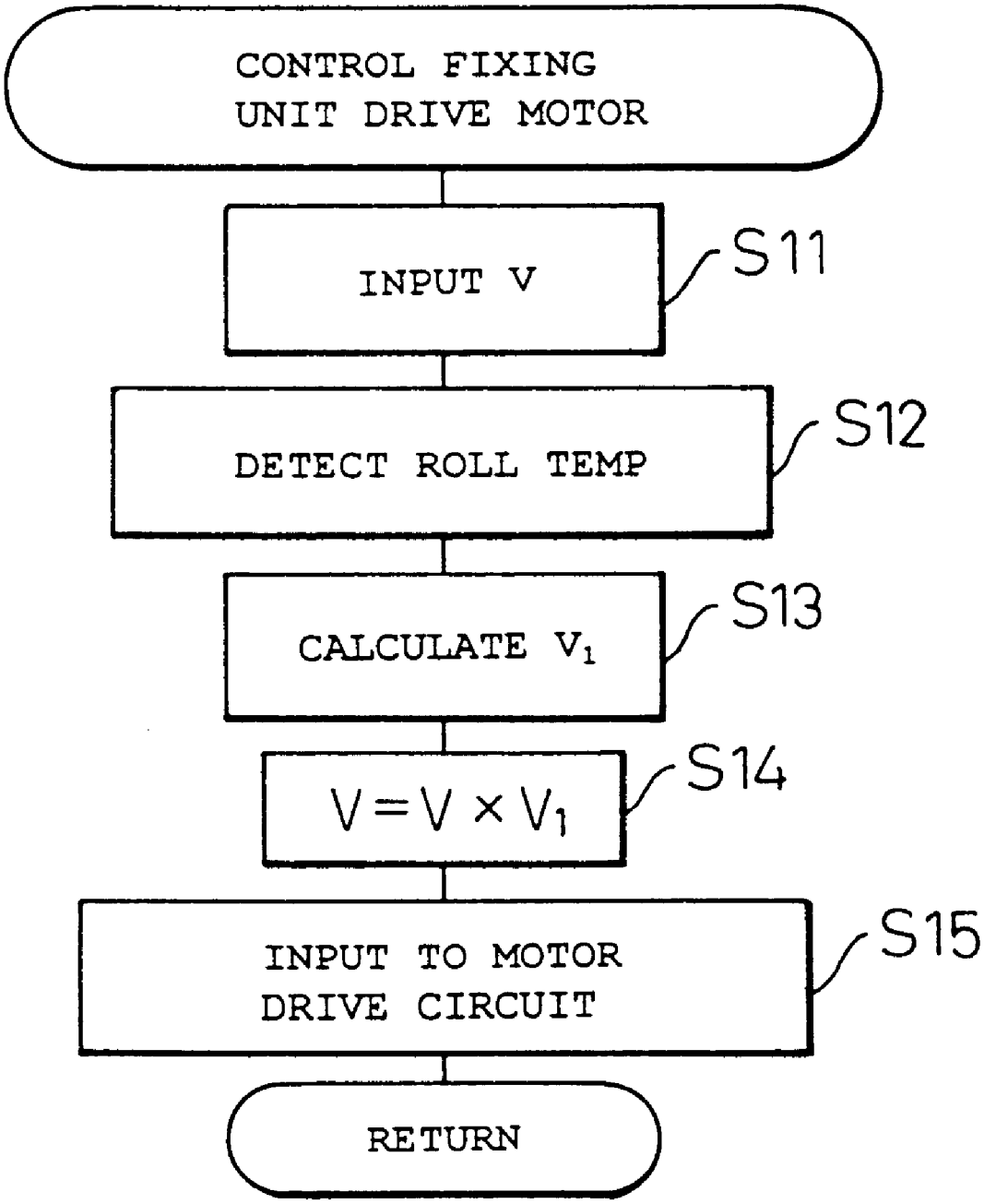
FIG. 24 is a flowchart showing an example of the speed control of the fixing rollers.

FIG. 24 is a flowchart showing an example of automatically setting the speed of the drive motor for the fixing rollers 66U, 66L using a temperature sensor. The temperature sensor is a thermistor 67U, for example, shown in FIG. 12.

In step S11 of FIG. 24, the speed value V of the drive motor of the fixing rollers 66u, 66L is input. In step S12, the temperature T of the fixing roller 66U is detected. In step S13, the speed change rate $V_1$ is calculated. The speed change rate $V_1$ is stored in a computer as the product of the functions of temperature. In step S14, the speed value V is determined as the product of the speed value V and the speed change rate $V_1$. In step S15, the speed value V thus corrected is input to the motor drive circuit for changing the rotational speed of the fixing rollers 66U, 66L.

It will thus be understood from the foregoing description that according to this invention, the provision of the fixing unit securing means operatively interlocked with the nip control mechanism simplifies the operation of mounting and demounting the fixing unit. Also, the fouling of the paper is suppressed by a movable paper guide or by correcting the speed of the fixing rollers. Further, the cleaning member for scraping off the toner from the fixing unit is efficient and has a long service life.

What is claimed is:

1. An image forming apparatus comprising:

a frame;

at least one print assembly capable of forming an image;

a fixing unit including a pair of fixing rollers for holding and conveying a paper sheet, a nip control mechanism for moving said pair of fixing rollers between a nip position and a non-nip position, and fixing unit securing means movable with said nip control mechanism for securing and releasing the fixing unit to and from the frame; and a paper sheet conveyor means for conveying the paper sheet to said fixing unit through said print assembly.

2. An image forming apparatus according to claim 1, characterized in that said at least one print assembly includes a plurality of print assemblies, each of said print assemblies includes a photosensitive member, a charger for charging said photosensitive member, latent image forming means for forming an electrostatic latent image on said photosensitive member, a developing unit for developing said electrostatic latent image, and a transfer element for transferring a developed toner image to the paper sheet, said latent image forming means being mounted on a top cover which is movably mounted on the frame to cover said print assembly.

3. An image forming apparatus according to claim 1, characterized in that said nip control mechanism moves with an end cover when said end cover moves from an open position to a closed position.

4. An image forming apparatus according to claim 1, characterized in that said frame has a positioning pin inserted in a hole of said fixing unit for positioning said fixing unit, and said fixing unit securing means includes a lock member adapted to engage said positioning pin in cooperation with said nip control mechanism.

5. An image forming apparatus according to claim 4, characterized in that said nip control mechanism includes manually operable levers, said lock member includes a cam plate movable with said levers, and said positioning pin has a small-diameter portion adapted to engage said cam plate.

* * * * *